US010683198B2

(12) United States Patent
Kelly et al.

(10) Patent No.: US 10,683,198 B2
(45) Date of Patent: Jun. 16, 2020

(54) BEVERAGE DISPENSING APPARATUS AND METHOD

(71) Applicant: Pernod Ricard SA, Paris (FR)

(72) Inventors: Steven John Kelly, Paris (FR); James Ashley Gadd, Paris (FR)

(73) Assignee: Pernod Ricard SA, Paris (FR)

( * ) Notice: Subject to any disclaimer, the term of this patent is extended or adjusted under 35 U.S.C. 154(b) by 75 days.

(21) Appl. No.: 15/521,344

(22) PCT Filed: Nov. 2, 2015

(86) PCT No.: PCT/EP2015/075482
§ 371 (c)(1),
(2) Date: Apr. 24, 2017

(87) PCT Pub. No.: WO2016/071292
PCT Pub. Date: May 12, 2016

(65) Prior Publication Data

US 2017/0313568 A1 Nov. 2, 2017

(30) Foreign Application Priority Data

Nov. 3, 2014 (GB) ..... 1419589.5

(51) Int. Cl.
*B67D 1/08* (2006.01)
*B67D 1/00* (2006.01)

(52) U.S. Cl.
CPC ..... *B67D 1/0881* (2013.01); *B67D 1/0001* (2013.01); *B67D 1/0079* (2013.01); *B67D 1/0888* (2013.01)

(58) Field of Classification Search
CPC .. B67D 1/0881; B67D 1/0001; B67D 1/0079; B67D 1/0888
(Continued)

(56) References Cited

U.S. PATENT DOCUMENTS 4,800,492 A * 1/1989 Johnson ..... B67D 1/0041 222/23
6,354,468 B1 3/2002 Riek
(Continued)

FOREIGN PATENT DOCUMENTS

EP 2789575 A2 10/2014
WO 0183360 A2 11/2001
(Continued)

*Primary Examiner* — Paul R Durand
*Assistant Examiner* — Andrew P Bainbridge
(74) *Attorney, Agent, or Firm* — Gable Gotwals

(57) ABSTRACT

The present invention is directed towards a beverage dispensing apparatus comprising at least one beverage dispensing module and a base unit upon or within which the or each module is positioned. Each module comprises a container housing a beverage reservoir and a beverage dispensing arrangement comprising a dispensing valve operable to be selectively opened to dispense beverage from the reservoir. Each module further comprises valve sensing means operable to determine when the dispensing valve is opened and provide a valve status signal indicative of whether the dispensing valve is opened. Each module further comprises communication means in communication with the valve sensing means and arranged to receive the valve status signal. The base unit comprises a base-module receiver operable to communicate with the communication means of one or more modules to receive the valve status signal therefrom. The apparatus is particularly suitable for alcoholic beverages.

6 Claims, 12 Drawing Sheets

(58) Field of Classification Search
USPC ..... 222/23, 77, 132, 135, 14, 25, 27–28, 222/36–37, 39, 64–65, 52; 700/231, 236, 700/240–244
See application file for complete search history.

(56) References Cited

U.S. PATENT DOCUMENTS

| | | | | |
|---|---|---|---|---|
| 6,375,043 | B1 * | 4/2002 | LeBlanc | B67D 1/0041 222/129.4 |
| 2005/0195087 | A1 | 9/2005 | Thompson et al. | |
| 2008/0197146 | A1 * | 8/2008 | Eyler | B67D 1/0888 222/39 |
| 2009/0069934 | A1 * | 3/2009 | Newman | B67D 1/0021 700/239 |
| 2009/0254215 | A1 * | 10/2009 | Hyde | G06F 19/3456 700/236 |
| 2011/0253746 | A1 * | 10/2011 | O'Keefe, Jr. | B67D 1/0005 222/132 |
| 2012/0218106 | A1 * | 8/2012 | Zaima | A61L 2/26 340/540 |
| 2014/0053944 | A1 * | 2/2014 | Wang | B67C 3/007 141/1 |
| 2017/0313568 | A1 * | 11/2017 | Kelly | B67D 1/0079 |
| 2017/0313569 | A1 * | 11/2017 | Yajima | B67D 1/08 |
| 2020/0031651 | A1 * | 1/2020 | Schneidewend | A47J 31/461 |

FOREIGN PATENT DOCUMENTS

| | | | |
|---|---|---|---|
| WO | 2009032875 | A2 | 3/2009 |
| WO | 2010042671 | A2 | 4/2010 |
| WO | 2011014950 | A1 | 2/2011 |
| WO | 2012024045 | A1 | 2/2012 |

* cited by examiner

BEVERAGE DISPENSING APPARATUS AND METHOD

CROSS-REFERENCE TO RELATED APPLICATIONS

This application is the United States National Phase of Patent Application No. PCT/EP2015/075482 filed 2 Nov. 2015, which claims priority to British Patent Application No. 1419589.5 filed 3 Nov. 2014, each of which are incorporated herein by reference.

BACKGROUND OF THE INVENTION

Technical Field

This invention is directed towards a beverage dispensing apparatus and method, which are particularly suitable for alcoholic beverages.

Background

Beverages, for example alcoholic beverages, sodas, concentrates and the like, are commonly supplied individually to consumers in bottles and typically glass bottles. However, glass bottles utilise space inefficiently when stacked, are relatively heavy and can be broken relatively easily when subjected to an impact. Therefore, they are not particularly suited to transportation. Furthermore, when a bottle is opened air is able to contact the beverage, which may result in the evaporation of the beverage and/or causing the beverage to degrade. For example, the alcohol in an alcoholic beverage will evaporate, thereby reducing the alcoholic content of the beverage. The air may also oxidise the alcohol such that the taste of the beverage changes.

Bag-in-box type containers commonly prevent air from contacting the beverage by comprising a one-way valve which allows beverage to flow out of, but prevents air from flowing into, the bag. However, such bag-in-box containers are not considered to be premium products by consumers and have, as a result, not replaced glass bottles as the typical beverage container. The bag-in-box type containers are also commonly very large (e.g. 3 to 5 litres) and are not suited to storing beverages, such as liquors, which are commonly supplied only in relatively small quantities (e.g. 1 litre). The box is also typically formed of cardboard or the like and thus has a relatively low structural strength. Therefore, they are not suited to vertical stacking in large numbers.

SUMMARY OF INVENTION

The present invention is directed in one aspect towards a beverage dispensing apparatus comprising: (a) at least one beverage dispensing module comprising: a container housing a beverage reservoir; a beverage dispensing arrangement comprising a dispensing valve operable to be selectively opened to dispense beverage from the reservoir; valve sensing means operable to determine when the dispensing valve is opened and provide a valve status signal indicative of whether the dispensing valve is opened; and communication means in communication with the valve sensing means and arranged to receive the valve status signal; and (b) a base unit upon or within which the or each module is positioned and comprising a base-module receiver operable to communicate with the communication means of one or more modules to receive the valve status signal therefrom. Preferably the at least one beverage dispensing module is separable from the base unit and the beverage dispensing arrangement is operable to selectively dispense beverage independently of the base unit.

The present invention is directed in a further aspect towards a method of operating a beverage dispensing system, said system comprising: a base unit comprising a control unit in communication with at least one base-module transceiver, said control unit comprising a memory; and at least one module mounted in or on the base unit, each module comprising: a dispensing arrangement for dispensing beverage from a beverage reservoir, the dispensing of beverage being controlled by a manually openable dispensing valve; communication means in communication with the at least one base-module transceiver; and valve sensing means operable to determine whether the dispensing valve is open and in communication with the communication means, wherein the method comprises the steps of: detecting the opening of the dispensing valve via the valve sensing means and generating a valve status signal indicative thereof; communicating the valve status signal indicative to the control unit via the communication means and at least one base-module transceiver; storing the valve status signal as valve status data on the control unit memory. Preferably the at least one beverage dispensing module is separable from the base unit and the beverage dispensing arrangement is operable to selectively dispense beverage independently of the base unit.

The present invention is directed in yet a further aspect towards a method of controlling a beverage dispensing system, said system comprising: a base unit comprising at least one visual indicator controlled by a control unit; and at least one module mounted in or on the base unit, the at least one module comprising: a dispensing arrangement for dispensing beverage from a beverage reservoir, the dispensing of beverage being controlled by a manually openable dispensing valve; and storage means storing module data including a predetermined flowrate of beverage from the module; wherein the method comprises the steps of: communicating the module data from the storage means of the at least one module to the control unit; calculating a time period for the dispensing of beverage from the at least one module based upon the predetermined flowrate and a desired amount of beverage to be dispensed; and indicating the at least one module with the at least one visual indicator for the calculated time period. Preferably the at least one beverage dispensing module is separable from the base unit and the beverage dispensing arrangement is operable to selectively dispense beverage independently of the base unit.

The present invention further provides a module or base unit and a beverage system comprising the aforementioned beverage dispensing apparatus.

The beverage dispensing module is suitable for containing alcoholic beverages and is particularly suitable for containing spirits, such as whisky, vodka, gin, liqueur, coffee liqueur, rum, aniseed-based spirit, pastis, cognac, brandy or tequila. The beverage dispensing container may also be suitable for containing other alcoholic beverages including champagne, wine, beer or cocktails, and/or other types of beverage, including sodas (also known as soft drinks) and beverage concentrates.

The present invention is directed towards a beverage dispensing apparatus in which at least one beverage dispensing module communicates with a base unit. In embodiments of a beverage dispensing system of the invention, the at least one beverage dispensing module and/or base unit is controlled from a mobile communication device via the base. The at least one beverage dispensing module may also be operable to dispense beverage independently of the base unit.

BRIEF DESCRIPTION OF THE DRAWINGS

By way of example only, embodiments of the present invention are now described with reference to, and as show in, the accompanying drawings, in which.

DETAILED DESCRIPTION

Figure 1:
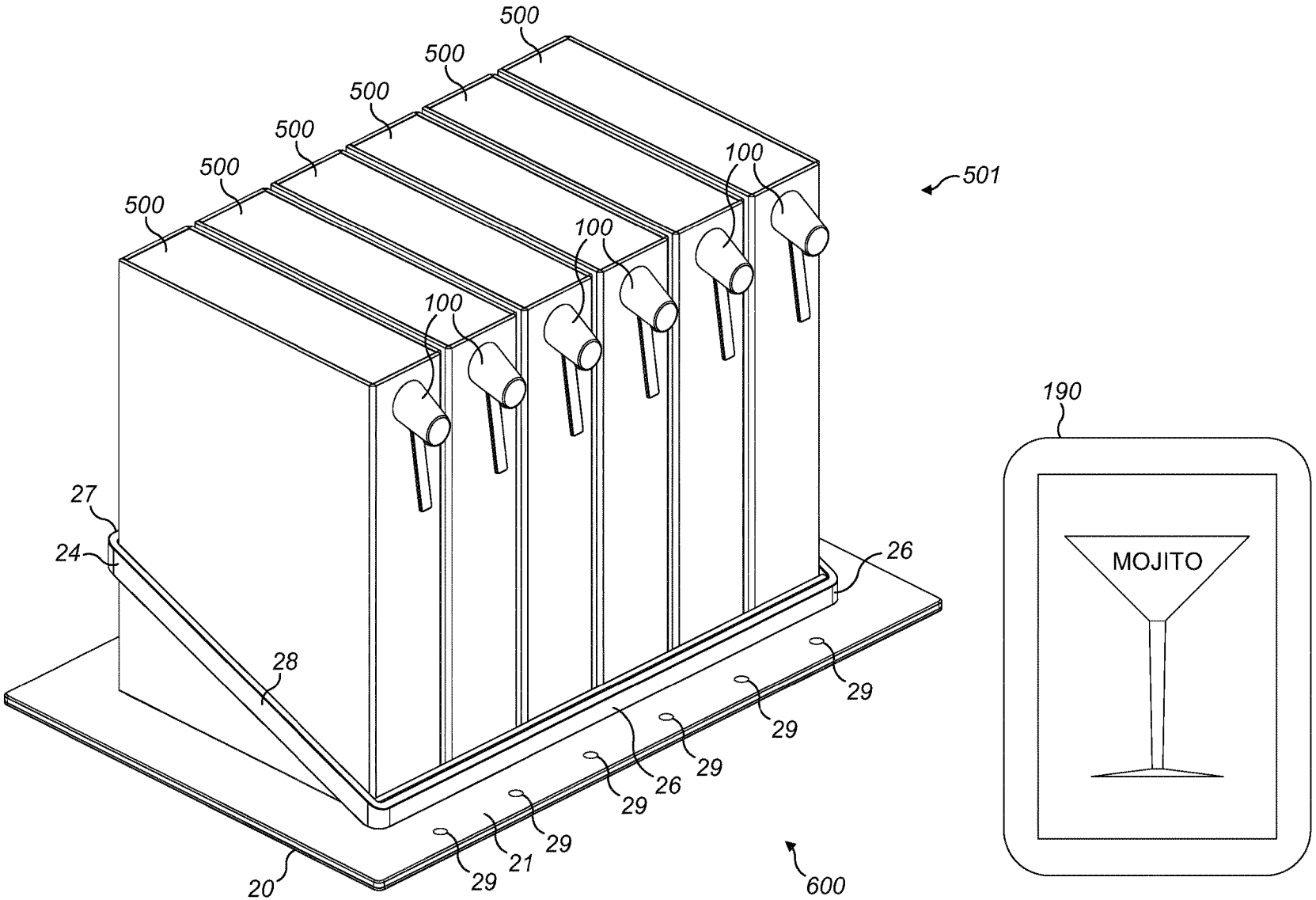
FIG. 1 is a view of the beverage dispensing system of the present invention.

FIG. 1 illustrates an embodiment of the present invention in which a beverage dispensing system 600 comprises a beverage dispensing apparatus 501 and a computing device 190 configured with suitable software/applications to allow control of and/or communication with the beverage dispensing apparatus 501. The beverage dispensing apparatus 501 comprises a plurality of beverage dispensing modules 500 supported on or in a base unit 20. As illustrated, each module 500 may be supported adjacent to at least one other module 500 on a support surface 21 of the base unit 20. Each module 500 is also operable to stand on a surface independently of the base unit 20.

1. The Beverage Dispensing Module(s)

Figure 2:
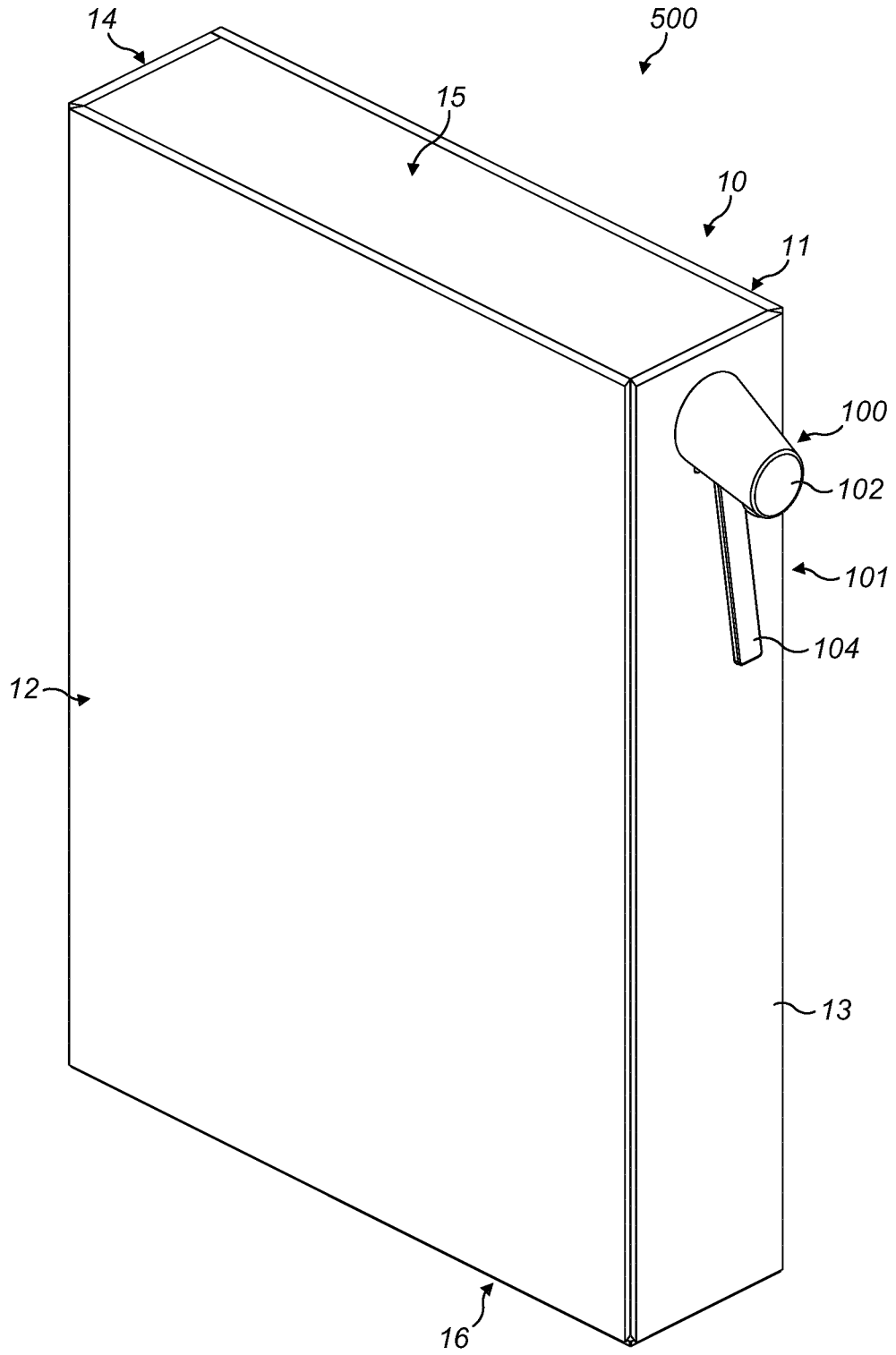
FIG. 2 is a perspective view of a beverage dispensing module of the system of FIG. 1.

As illustrated further in FIG. 2, each module 500 is generally bibliomorphic (book shaped). The module 500 comprises a container 10 having first and second major side walls 11, 12, first and second minor side walls 13, 14 and first and second end walls 15, 16. In the present disclosure the term "minor" is used to indicate a small dimension (e.g. area or length) and the term "major" is used to indicate a larger dimension. For example, the surface area of each of the first and second major side walls 11, 12 is larger than the surface area of each of the first and second minor side walls 13, 14.

1.1 Module Construction

The walls are preferably each substantially rectangular in shape. Each major edge of the first and second major side walls 11, 12 is coincident with a major edge of the first or second minor side wall 13, 14. Each minor edge of the first and second major side walls 11, 12 is coincident with a major edge of the first and second end walls 15, 16. Each minor edge of the first and second minor side walls 13, 14 is coincident with a minor edge of the first and second end walls 15, 16. The container 10 therefore has a substantially rectangular cuboidal shape. In alternative embodiments the container 10 has another suitable shape, such as a cube or square cuboid which may have, for example, rounded corners or the like.

The beverage dispensing module 500 further comprises a beverage dispensing arrangement 100. The beverage dispensing arrangement 100 comprises an outlet arrangement 101 for controlling liquid beverage flow or selectively dispensing liquid beverage from a beverage reservoir located within the container 10. The outlet arrangement 101 comprises an outlet nozzle 102 mounted to the outside of the container 10 and a beverage dispensing valve 103 located at least partially within the container 10. The beverage dispensing valve 103 is controlled by a manually actuatable dispensing actuator 104, for example in the form of a lever.

Figure 3:
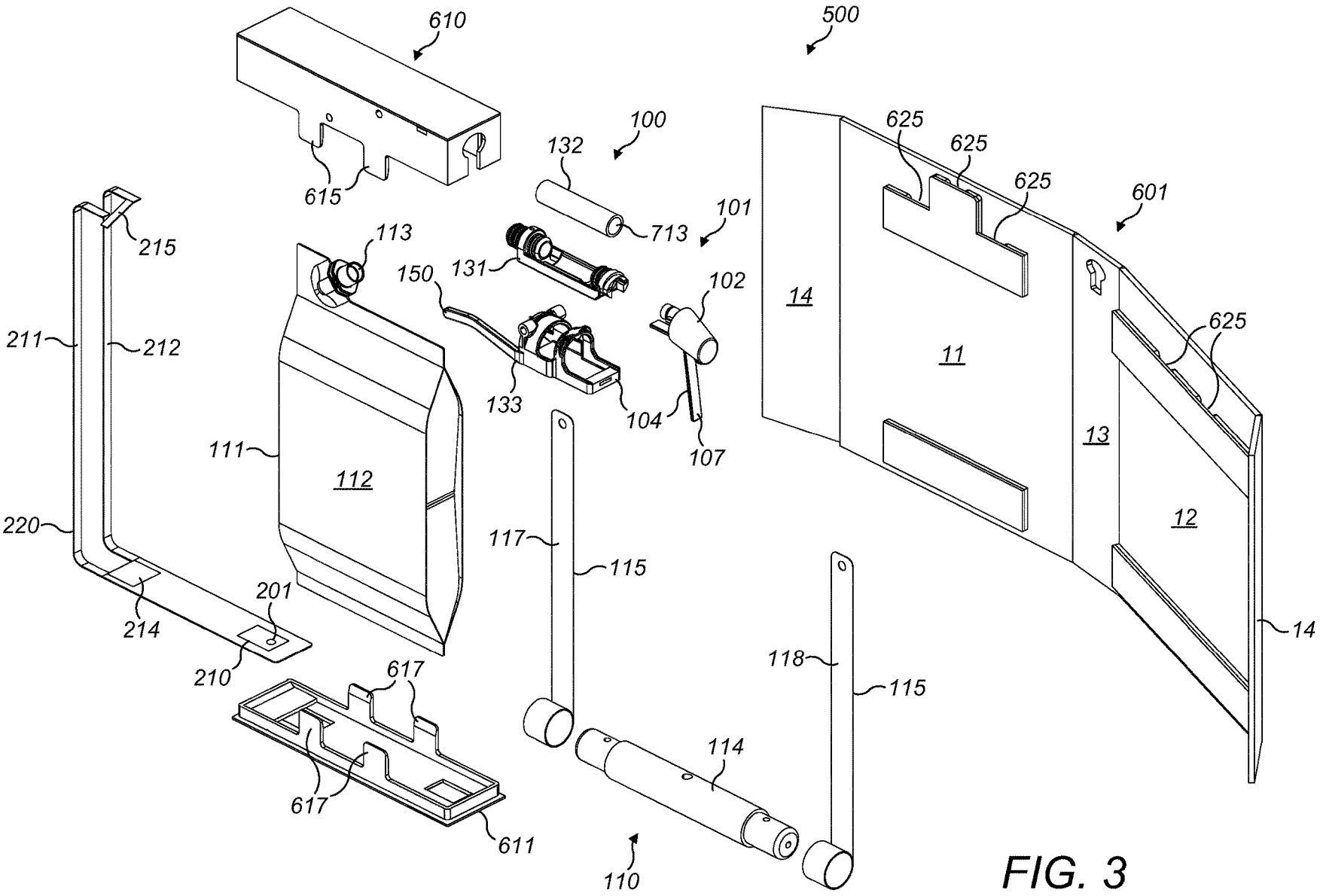
FIG. 3 is an exploded perspective view of the module of FIG. 2.
Figure 4:
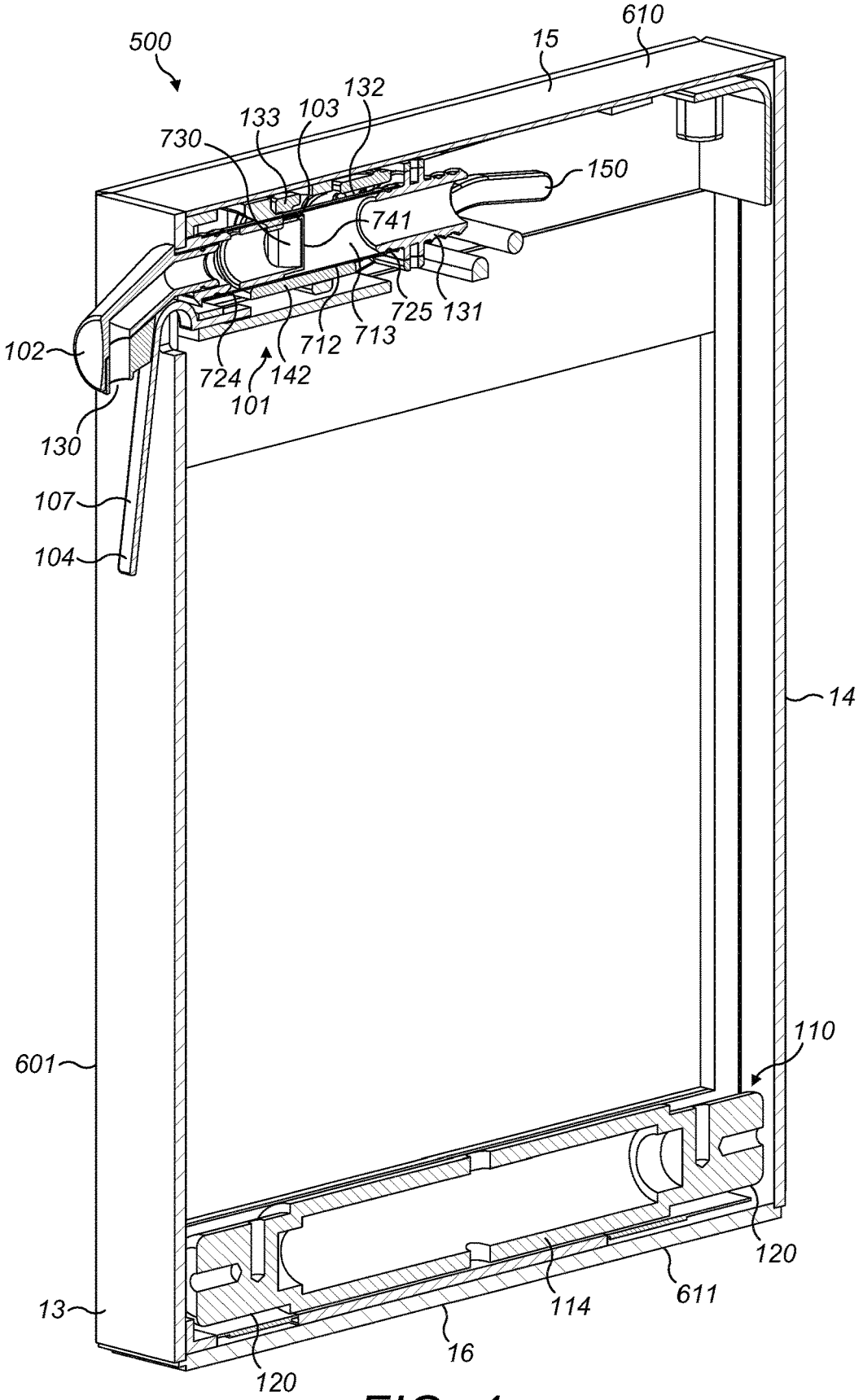
FIG. 4 is a cross-sectional view of the module of FIG. 2 with a reservoir hidden for clarity.

FIG. 3 illustrates an exploded view of the module 500 when constructed in a preferred embodiment. FIGS. 4 to 7 illustrate the components of the module 500 and beverage dispensing arrangement 100 in further detail. The container 10 to which the beverage dispensing arrangement 100 is attached comprises a housing 601 and first and second end covers 610, 611. The housing 601 comprises the a panel which, when wrapped, forms the first and second major and minor side walls 11, 12, 13, 14 and, at either end thereof, forms an opening for receiving the first and second end covers 610, 611. The first and second end covers 610, 611 comprise at least one protrusion 615, 617 for mounting into recesses 625 formed in, or adjacent to, the inner face of at least one of the side walls 11, 12, 13, 14. The engagement between the protrusions 615, 617 and recesses 625 holds the end covers 610, 611 in place.

The container 10 is preferably shaped and sized to fit through a domestic letterbox (mail slot). In Europe, the opening in such a letterbox is typically around 250 mm wide and around 30-40 mm high, so the dimensions of a cross-section of the container 10 may be less than, say, 250 mm×40 mm. In a particular embodiment, the container 10 has the dimensions of about 200 mm×150 mm×36 mm. Preferably the minor dimension of the first and second minor sides walls 13, 14 and first and second end walls 15, 16 is less than 40 mm, more preferably less than 35 mm and more preferably less than 30 mm. Such dimensions equally permit delivery of the container 10 to a curbside mailbox such as is common in North America.

1.2 Dispensing Arrangement

The beverage dispensing arrangement 100 generally comprises a pressurising arrangement 110 for applying pressure to a compressible beverage reservoir 111 containing a beverage. Compressing the reservoir 111 causes the beverage in turn to flow along the outlet arrangement 101, which comprises the outlet nozzle 102, the dispensing valve 103 and a dispensing conduit 106 formed between the body of the reservoir 111 and the outlet nozzle 102. The beverage presses against the dispensing valve 103 until opened by the dispensing actuator 104, when beverage is driven from the reservoir 111, along the dispensing conduit 106, through the dispensing valve 103 and out of the container 10 via the outlet nozzle 102. Preferably there are no air gaps within the reservoir 111, such that as beverage is ejected the internal volume of the reservoir 111 is reduced.

The reservoir 111 preferably comprises a pouch 112 formed of a flexible membrane having an outlet 113 connected and sealed to the outlet arrangement 101. The pressurising arrangement 110 comprises a roller 114 and a resilient bias means 115 or mechanism. An end of the pouch 112 is attached along the length of the roller 114. The resilient bias means 115 is arranged to roll the roller 114 such that the internal volume of the pouch 112 is reduced by wrapping the pouch 112 around the roller 114 as beverage is dispensed from the pouch 112. In the illustrated embodiments the resilient bias means 115 comprises first and second springs 117, 118, each attached at either end of the roller 114. However, it will be appreciated that the resilient bias means 115 could be in any other suitable form, for example comprising one or more elasticated members. In addition, the pressurising arrangement 110 could take any other form, such as a manually, electrically or mechanically driven pump or the like.

1.3 Outlet Arrangement

The outlet arrangement 101 comprises the outlet nozzle 102, an intermediary adapter 131, a valve arrangement 132 and a lever arrangement 133. The outlet nozzle 102 comprises an outlet aperture 130 at one end of an internal passageway 134 and an inlet aperture 135 and nozzle inlet adapter 136 at the opposing end of the internal passageway 134. The nozzle inlet adapter 136 comprises a hollow tube for mating to the intermediary adapter 131.

The outlet nozzle 102 is mounted on and projects from the first minor side wall 13 and is generally offset from the centre line parallel to the minor edges of the first minor side wall 13. When the second end wall 16 stands on a surface, the outlet nozzle 102 is located in the upper half of the first minor side wall 13. However, it will be appreciated that the module 500 may be adapted such that the outlet nozzle 102 is on any of the other side walls 11, 12, 14. Although it is not essential that the outlet nozzle 102 be positioned in the upper half of the side walls 11, 13, 12, 14, by locating the outlet nozzle 102 in that upper half, sufficient height is provided to allow a glass other drinks receptacle to be placed underneath the outlet nozzle 102 so that beverage can be dispensed directly into that drinks receptacle whilst it sits on a surface next to the container 10.

The intermediary adapter 131 is sealed and connected at a first outer connector 137 to the nozzle inlet adapter 136 and at a second outer connector 138 to the pouch outlet 113. The first outer connector 137 may comprise a hollow tube which receives the hollow tube of the nozzle inlet adapter 136 and the second outer connector 138 may comprise a hollow tube inserted into connecting means of the pouch adaptor 270. The intermediary adapter 131 further comprises first and second inner connectors 139, 140, each in fluid communication with the first and second outer connectors 137, 138 respectively, in the form of hollow tubes extending towards one another. The intermediary adapter 131 also comprises a valve support wall 142 located underneath the valve arrangement 132.

The valve arrangement 132 comprises a tube 141 and the dispensing valve 103 is disposed therein. The dispensing valve 103 may be a one-way or check valve, which only opens when actuated by the dispensing actuator 104, and prevents the ingress of air into the reservoir 111 to prevent the beverage contained therein from deteriorating. Preferably the dispensing valve 103 is a duckbill valve 730 and the duckbill valve disclosed in UK Patent Application No. 1411147, which is incorporated herein by reference, is particularly suitable. In such an arrangement, the tube 141 comprises a tube wall 712 forming an elongate passageway 713 having a first end 724 sealed to the first inner connector 139 and a second end 725 sealed to the second inner connector 140. The duckbill valve 730 comprises an elongate valve mouth 741 and the dispensing actuator 104 is operable to apply a compressive force along the lateral direction (i.e. in the plane along which the valve mouth 741 extends when closed) to open the valve mouth 741. The tube 141 and dispensing valve 103 are preferably formed of a resiliently deformable material. The dispensing conduit 106 therefore leads from the pouch outlet 113 to, in order of fluid flow during dispensing, the second outer connector 138, the second inner connector 140, the passageway 713, the first inner connector 140, the nozzle inlet adapter 136, the internal passageway 134 and, finally, the outlet aperture 130.

The dispensing actuator 104 comprises the lever arrangement 133 and a dispensing lever 107 connected to the lever arrangement 133. The dispensing lever 107 is provided outside of the container 10 for a user to actuate, whilst the lever arrangement 133 is provided within the container 10 for translating the actuation of the dispensing lever 107 into the opening of the dispensing valve 103.

The lever arrangement 133 comprises a substantially rectangular, ring-shaped, main body 145 extending from adjacent to the outlet nozzle 102 towards a pivot arm 146 substantially adjacent to the second inner and outer connectors 138, 140. The pivot arm 146 extends from the main body 145 upwards and around the intermediary adapter 131 and valve arrangement 132 from one side of the ring of the main body 145 to the opposing side. The pivot arm 146 is attached to the container 10 such that it is pivotable about a pivot axis 147. For example, a rod (not shown) may extend through a passageway in the pivot arm 146 and be inserted at either end into apertures in the first end cover 610.

The lever arrangement 133 further comprises a valve arm 148 extending from one side of the ring of the main body 145 to the opposing side and disposed over the dispensing valve 103, particularly the valve mouth 741, within the valve arrangement 132. The valve support wall 142 is provided on the opposite side of the valve arrangement 132 to the valve arm 148. The dispensing lever 107 is mounted to the main body 145 by being inserted into a slot 149 in the main body 145 adjacent to the outlet nozzle 102. The valve arm 148 is located towards the dispensing lever 107 from the pivot arm 146.

The pressurising arrangement 110 pressurises the beverage against the dispensing valve 103 when it is closed. The dispensing actuator 104 is operable to dispense beverage from the valve mouth 741 such that the overpressure causes beverage to be ejected from the opening. In particular, when the dispensing lever 107 is pressed downwards, the main body 145 and valve arm 148 move downwards such that the lever arrangement 133 pivots about the pivot axis 147. The valve arm 148 also thereby moves downwards and compresses the dispensing valve 103 against the valve support wall 142 such that the valve mouth 741 opens.

An arm 150 also extends into the container 10 from the main body 145. When the dispensing lever 107 is pressed downwards the lever arrangement 133 pivots about the pivot axis 147 and the arm 150 moves upwards. The operation of the arm 150 will be described in further detail below.

1.4 Dispense Sensing Means

The module 500 further comprises dispensing valve sensing means 220 arranged to determine when the dispensing valve 103 is open or opened and provide a valve status signal indicative of whether the dispensing valve 103 is opened. The dispensing valve sensing means 220 may comprise any suitable arrangement for determining the status of the dispensing valve 103, whether directly by determining if the valve mouth 741 is open or indirectly by determining the status of the dispensing actuator 104.

In the embodiment illustrated in FIGS. 3 to 7 the dispensing valve sensing means 220 comprises the arm 150 and a circuit 213. The circuit 213 comprises first and second conductive elements or strips 211, 212 attached to a first communication means 214. The first and second conductive strips 211, 212 are provided within the container 10 such that they extend from free ends at the first end wall 15, along the second minor wall 14 and down to the second end wall 16 at the first communication means 214. A free end of the second conductive strip 212 is arranged to be moved by the arm 150 such that it contacts a free end of the first conductive strip 211, thereby forming a switch 215. When the dispensing lever 107 is depressed outside of the module 500 the switch 215 will close and the circuit 213 will be completed. In another embodiment the switch 215 is normally closed and, upon actuation of the dispensing lever 107, the switch 215 will close. Preferably the first communication means 214 comprises a wire coil suitable for interrogation and/or inductance by an inductive sensor.

Figure 8:
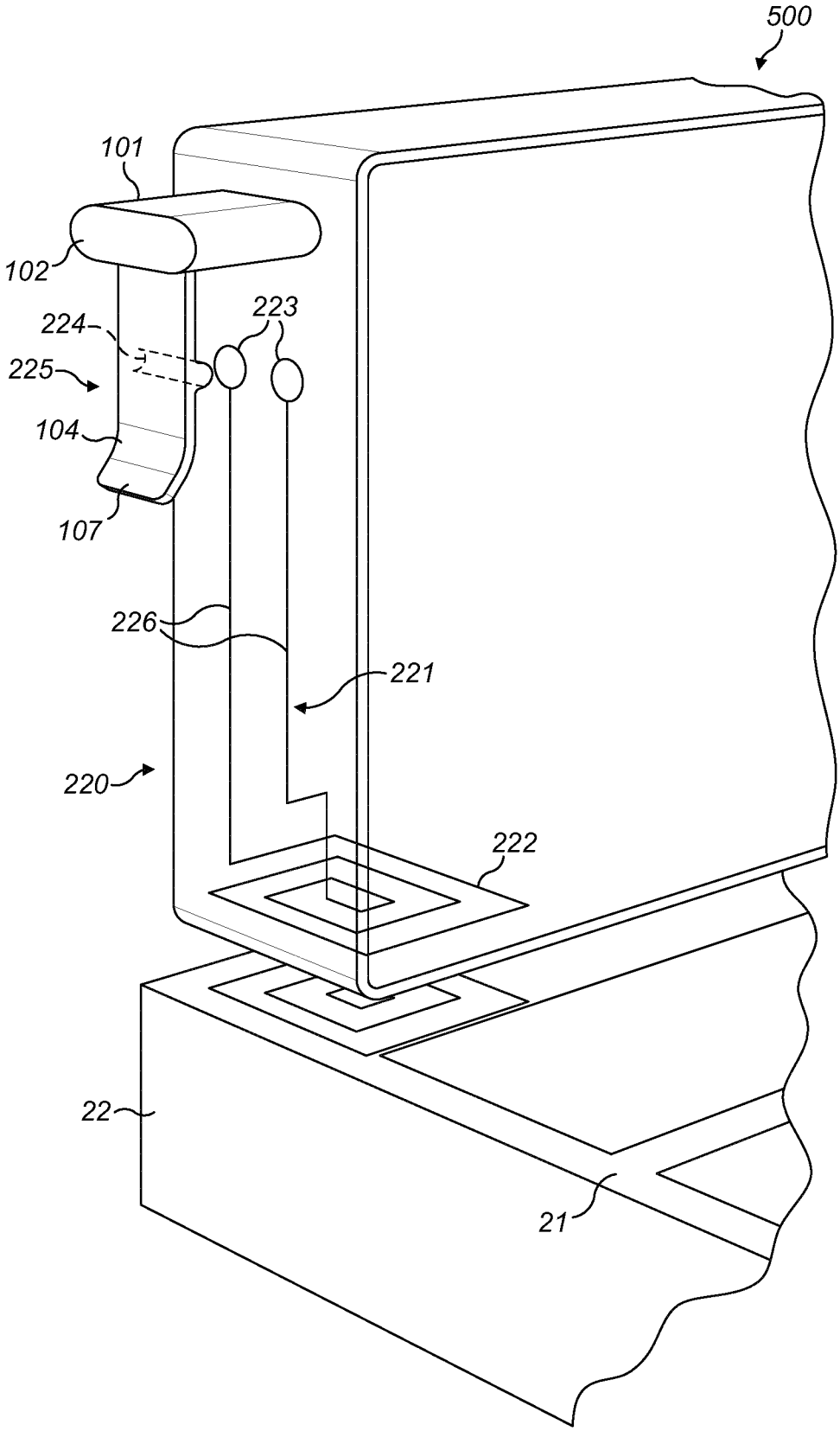
FIG. 8 is a perspective schematic view of a further embodiment of a beverage dispensing module illustrating a dispense sensing means.

In a further embodiment, as illustrated in FIG. 8, the dispensing valve sensing means 220 comprises an electric circuit 221 comprising a first communication means 222 connected via conductive elements 226 to separated contacts 223. The first communication means 222 is mounted at the bottom of the module 500 on the inner face of the second end wall 16 adjacent to the base unit 20. The conductive elements 226 extend from the first communication means 222 along the inside of the container 10 from the second end wall 16 along the first minor side wall 13 and up to the separated contacts 223, which are provided in proximity to the dispensing lever 107 and on the outer face of the first minor side wall 13. Contact connection means 224, for example formed of a conductive backing, are provided on an inner side of the dispensing lever 107 in proximity to the separated contacts 223. The contacts 223 and contact connection means 224 form a switch 225, which, in the present embodiment, is closed when the dispensing actuator 104 is manually actuated as the lever moves the contact connection means 224 into contact with both of the contacts 223, thereby completing a circuit with the first communication means 222.

The electric circuit 221 or conductive strips 211, 212 are preferably formed as a stamped or lithographic foil on a laminar substrate. The laminar substrate may extend from the second end wall 16, along the first or second minor side wall 13, 14 and to the top of the module 500 adjacent to the beverage dispensing actuator 104. The first communication means 214, 222 is also preferably formed on the laminar substrate. Therefore, during assembly of the module 500, the laminar substrate can be easily mounted to the module 500 by adhering it to the inside of the walls forming the module 500. In particular, where the walls of the module 500 are formed from a flat blank of material (such as the housing 601 of FIG. 3), the laminar substrate can be applied to the blank before it is folded into shape.

When the switches 215, 225 are closed the dispensing valve sensing means 220 are operable to provide a valve status signal indicative of whether the dispensing valve 103 is opened. In the illustrated embodiments the dispensing valve sensing means 220 are arranged to provide the valve status signal upon interrogation via the first communication means 214, 222. For example, the first communication means 214, 222 may be operable to induce a current in the electrical circuit 213, 221 and the valve status signal is positive and provided in the form of the current passing around the electrical circuit 213, 221 when the switches 215, 225 are closed. If the switches 215, 225 are open then no current will pass around the electrical circuit 213, 221, indicating that the dispensing valve 103 is closed. Thus the valve status signal may not be generated since the current is not returned to the first communication means 214, 222 after induction. Alternatively, a separate power supply (such as a battery) may be provided in the electrical circuit 213, 221 to generate the current.

The first communication means 214, 222 comprises any suitable means which can be interrogated by a sensor, such as an antenna. In particular, the first communication means 214, 222 may be in the form of a metal (such as copper) wire coil in which a current can be induced by an inductive sensor. Alternatively, the first communication means 214, 222 may comprise an RFID or NFC tag.

1.5 Storage Means

Figure 9:
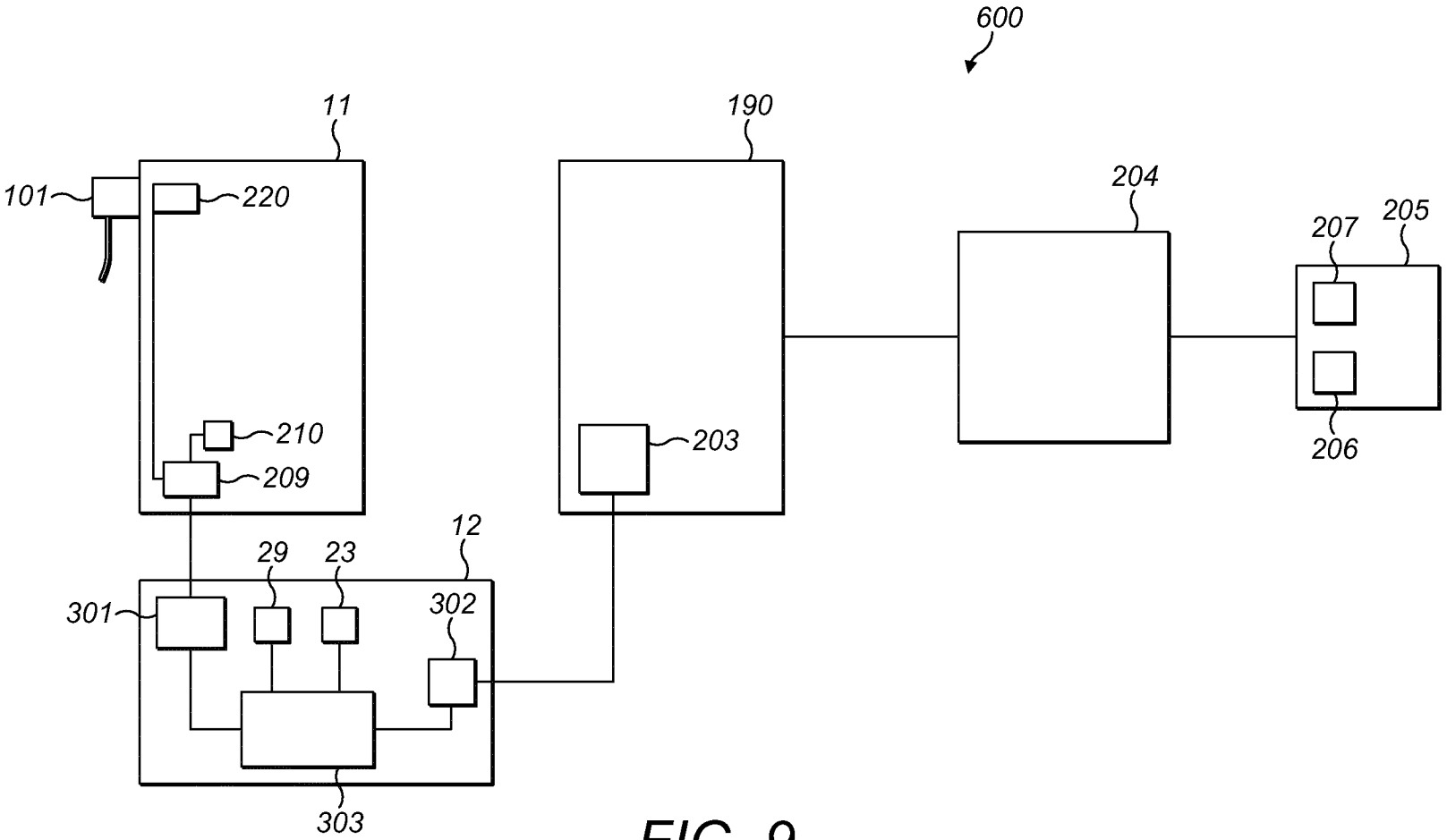
FIG. 9 is a schematic of the beverage dispensing system of FIG. 1.

The module 500 further comprises a storage means 210 operable to store module data, the data being capable of being read by or communicated to the computing means 190 via communication means. As illustrated in FIG. 3, the storage means 210 may be in communication with a dedicated second communication means 201. However, in other embodiments, such as is illustrated in FIG. 9, the storage means 210 may be in communication with a shared communication means 209 with which the dispensing valve sensing means 220 communicates.

The storage means 210 may also include data relating to advertising content and/or a link. The link may include at least one of: a URL (uniform resource locator), a website address, a file path and/or the like. The URL and website address are operable to direct the computing device 190 to the content stored on external server(s). The advertising content may comprise details of particular products and/or services available for purchasing by the user. Preferably, the advertising content is based upon associated user information and beverage information.

The module data, being stored as static or dynamic content, relates to at least one of: beverage information relating to the type of beverage stored in the reservoir, the module history, module identification, the module weight, the dispense status, flow rates and/or the like.

The beverage type information stored within the storage means 210 comprises content relating to a plurality of different beverage types. The content for each beverage type may include at least one of: the type of beverage, the trade name of the beverage, the alcoholic content of the beverage, the density of the beverage, the composition of the beverage, the manner in which the beverage is preferably served (e.g. temperature, type of drinking vessel from which a user should preferably drink it), liquids and/or solids with which the beverage is preferably not mixed, the names of other beverages and/or foods with which the beverage is preferably mixed, the temperature at which the beverage is preferably stored, the history of the production of the beverage, other flavours of the beverage, associated beverages and/or the like.

The module identification data may comprise information relating to the specific module 500 on which the storage means 210 is mounted and the beverage contained therein. For example, it may comprise the module 500 issue date, the date and/or place the beverage was provided in the module 500, the volume of beverage initially contained in a module 500, the date of manufacture of the beverage, the date of expiry of the beverage and/or the time from the date of manufacture to the date of expiry. Such information may be used by the beverage dispensing system to determine the presence of counterfeit or refilled modules 500 and, then, prevent the system from permitting dispensing of beverage as a result. The module identification data may further include a unique module identification number/code (i.e. an authenticity code) for preventing counterfeiting or a module series number. Preferably the authenticity code is stored as static data such that it cannot be overwritten by a counterfeiter.

The module history data may comprise information relating to the past use of the base unit 20, particularly in relation to the module 500 on which the module 500 is positioned (i.e. "docked") or was previously docked with. For example, it may further comprise an ID code for the last base unit 20 with which the module was docked, the software version on the last base unit 20 with which the module was docked, the time the module was last docked with a base unit 20, the time the module was last undocked from a base unit 20, the time a last dispense event (i.e. opening and closing of the dispensing valve 103) started and/or ended, the duration of the last dispense event and the number of dispense events implemented on the module 500 whilst the module 500 has been docked to a base unit 20.

The dispense status data may comprise information relating to the current status of the dispensing valve 103. For example, the dispense status data may indicate if: the dispensing valve 103 is not dispensing, dispensing is starting, dispensing is occurring, dispensing is ending, the dispensing lever 107 is depressed but no beverage is being dispensed and/or the like.

The module weight data may comprise information relating to the weight and/or volume of beverage in the module 500. For example, the module weight data may include the weight of the module 500 when full, the weight of the module 500 when empty, the last weight measured by a base unit 20 when the module 500 was docked and a weight uncertainty value (an accumulated uncertainty from one or more overlapping module events that could not be resolved as explained below).

The flow rate data may relate to the flow rate of beverage from the module 500. For example, the flow rate data may include the flow rate of beverage out of the module 500 during the last dispense event whilst the module 500 was docked to a base unit 20, a range of or value for a predetermined flow rate, a maximum adjustment which can be made to the flow rate per dispense calibration and a minimum dispense time for a dispense event to qualify as being suitable for a flow rate calibration.

The storage means 210 and second or shared communication means 201, 209 may be a passive, semi-active or active device or devices arranged to be interrogated by the base unit 20 and/or by the computing device 190. Preferably the storage means 210 is rewritable such that the module data thereon can be changed. However, certain embodiments of the present invention may comprise read-only storage means 210.

In a first embodiment the storage means 210 and second or shared communication means 201, 209 are passive and are not powered by a power source on the module 500. Preferably the storage means 210 and second or shared communication means 201, 209 are in the form of a passive electronic tag, more preferably a passive RFID (radio-frequency identification) tag and yet more preferably an NFC (near field communication) tag. The transmission frequency for reading data on the tag is the standard frequency of 13.56 MHz. The storage means 210 only provides the module data when interrogated by a power-providing reader (see below). Alternatively the storage means 210 and second communication means 201 are formed as a linear or matrix barcode, such as a QR Code®, readable by an imaging device, such as a digital camera, of the computing device 190 or base unit 20.

In a second embodiment the storage means 210 and second or shared communication means 201, 209 are semi-active in that they are partially powered by a power source on the module 500. Preferably, the storage means 210 and second or shared communication means 201, 209 are formed as a read-write RFID or NFC tag. A power supply, such as a battery mounted within or on the module 500 or the base unit 20, or a mains supply, provides power to the storage means 210 and second or shared communication means 201, 209. The storage means 210 only provides the module data when interrogated by a power-providing reader (see below).

In a third embodiment the storage means 210 and second or shared communication means 201, 209 are active and the second or shared communication means 201, 209 comprise a transmitter and receiver. The second or shared communication means 201, 209 preferably comprises a WLAN (wireless local area network) interface, a Bluetooth® interface, an active RFID tag, an active NFC tag or the like. The module 500 further comprises a control unit and the storage means 210, in the form of a memory, is in communication with the control unit. The control unit is operable to interact via the second or shared communication means 201, 209 with the computing device 190, either directly or via the base unit 20. The control unit may also be operable to collect data relating to the state of the beverage in the module 500, for example via a load sensing means. The module control unit may also operable to be controlled either directly from the computing device 190 or from the computing device 190 via the base unit 20.

2. The Base Unit

Figure 10:
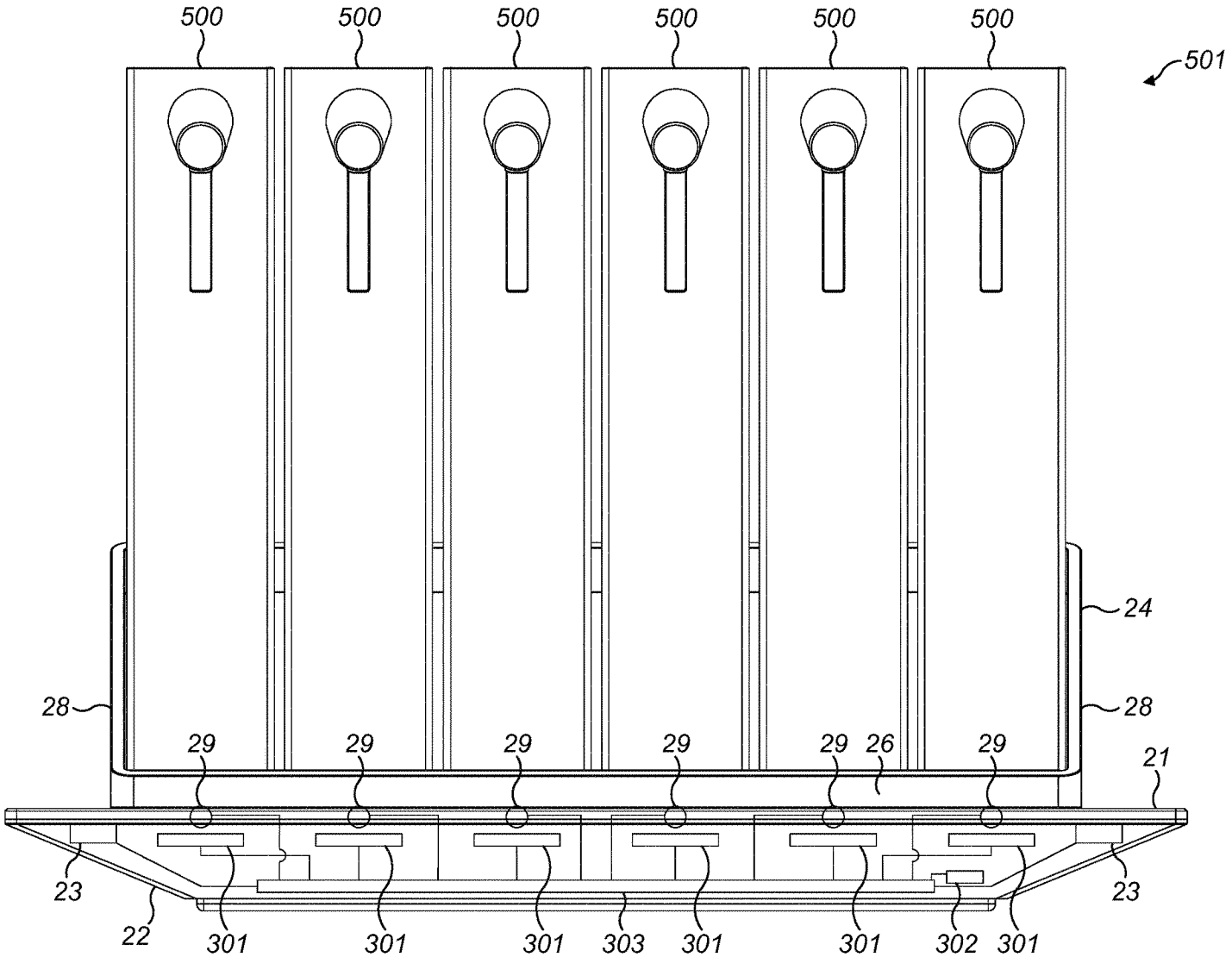
FIG. 10 is a front elevation of a beverage dispensing apparatus of the system of FIG. 1 with a schematic illustration of a control arrangement in a base unit.

In the beverage dispensing apparatus 501 illustrated in FIGS. 1 and 10 the base unit 20 comprises a generally planar support surface 21 on which one or more modules 500 may rest. The support surface 21 is mounted to a lower housing 22. The base unit 20 may be sized for supporting any number of modules 500 in any suitable arrangement. In particular, the base unit 20 may comprise a plurality of module locations, each for supporting one module 500. Each mount may simply be defined by a surface area of the support surface 21 and is denoted by a marking or the like on the support surface 21. Alternatively, the module locations may comprise means for physically separating one module 500 from another such that a module 500 cannot overlap two module locations.

In other embodiments the support surface 21 has a different shape that cooperates with the plurality of modules 500. For example, the support surface 21 may comprise a plurality of steps at different heights and the underside of modules 500 may be supported by a single step forming a module location. As a result, the top side of each module 500 may be at a different height to one or more other modules 500. Alternatively, one or more modules 500 may be provided with different heights that correspond to the heights of the steps. Therefore, when the modules 500 are supported by the different steps of the support surface 21, the top side of each module 500 is at the same height.

Alternatively or additionally, each module 500 may be stabilised on the base unit 20 by complementary magnets, clips or other stabilisation means, each forming a module location. In particular, the support surface 21 may comprise a plurality of upstanding protrusions, each forming a module location, and the container 10 of each module 500 may comprise a corresponding recess in the second end wall 16.

When the protrusions and recesses cooperate, the module 500 may be prevented from sliding along the support surface 21. Such an arrangement prevents the module 500 from tipping over if knocked accidentally.

Figure 11:
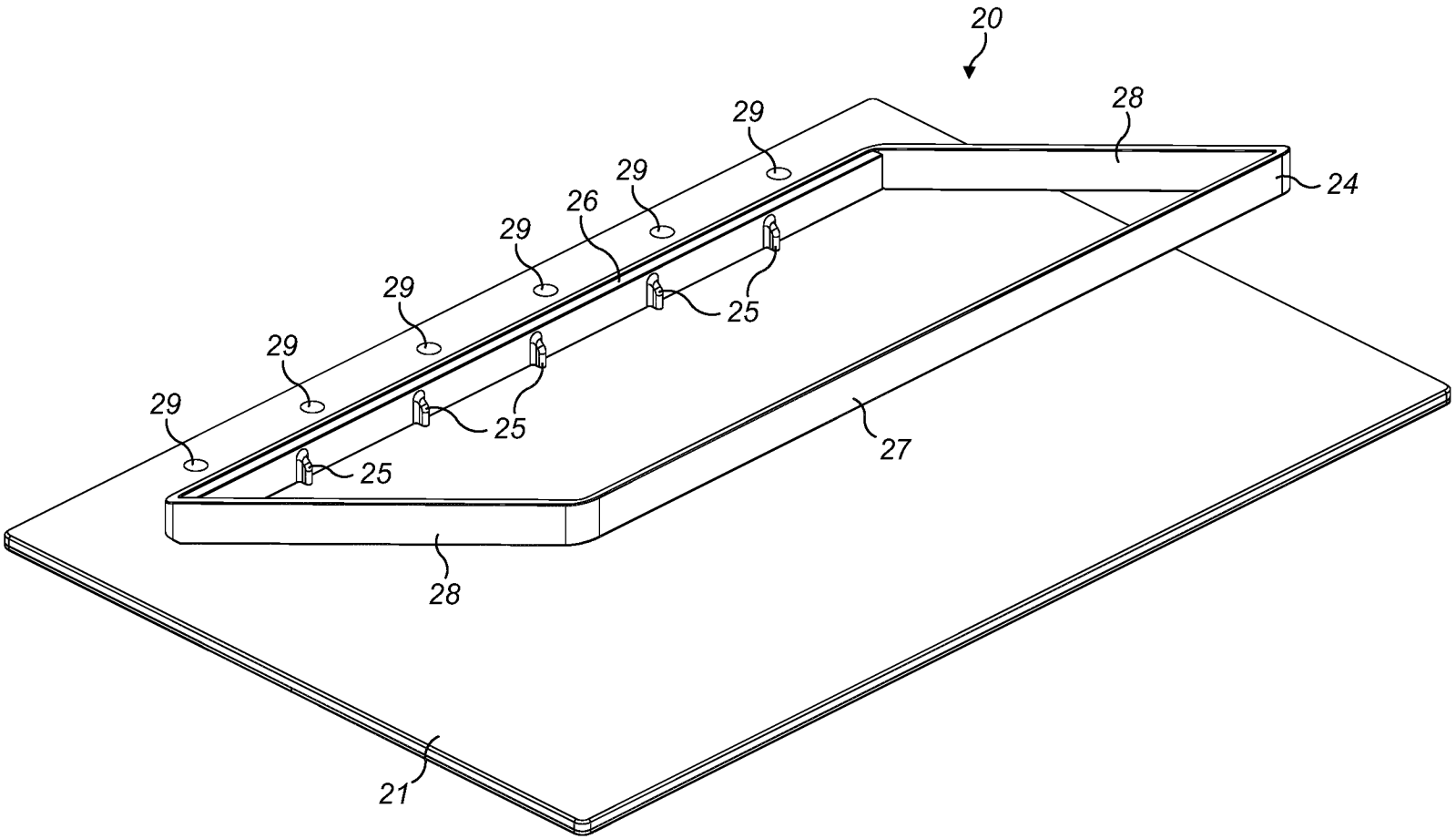
FIG. 11 is a rear perspective view of a base unit of the system of FIG. 1.

As may be seen in FIGS. 1, 10 and 11, the base unit 20 preferably includes a retaining arm 24, which extends circumferentially around the edge of the base unit 20. A front part 26 of the retaining arm 24 is preferably attached, for example using an adhesive or mechanical fastening means (such as a screw) to the base unit 20 toward a front edge thereof. Side parts 28 of the retaining arm 24 extend rearwardly and away from the base unit 20 and a back part 27 of the retaining arm 24 is thus cantilevered above a rear edge of the base unit 20. A series of locating lugs 25 are provided along a rear edge of the front part 26 of the retaining arm 24. These lugs 25 define the module locations therebetween and assist with correct positioning of individual beverage dispensing modules 500 upon the base unit 20, in use. The retaining arm 24, more generally, provides mechanical support to the modules 500, whose centre of gravity is such that they otherwise would have a tendency to tip sideways. The retaining arm 24 also prevents the modules 500 from sliding backwards off the base unit 20 when, for example, the dispensing actuator 104 is pushed to dispense the beverage, since that action generates a force upon the module 500 acting in a rearward direction relative to the base unit 20.

Although the retaining arm 24 is shown in FIGS. 1, 10 and 11 with a cantilevered arrangement, it will of course be understood that this is not essential to the appropriate functioning of the retaining arm 24, and, for example, supporting struts may be provided, extending from the base unit 20 in a generally vertical direction towards the side parts 28 and/or back part 27 of the retaining arm 24 so as to provide vertical support for the retaining arm 24.

Figure 5:
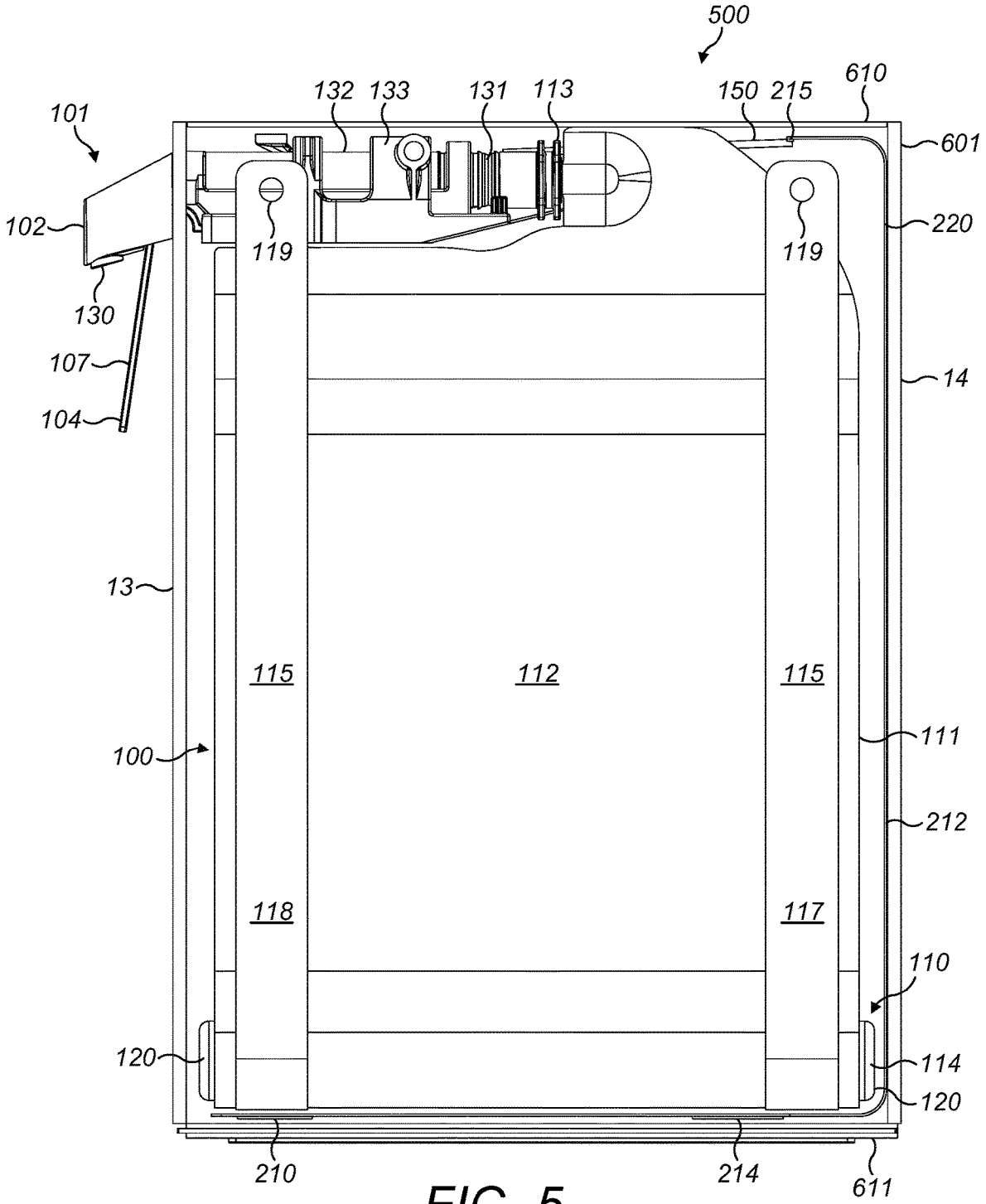
FIG. 5 is a side elevation of the module of FIG. 2 with a side wall hidden to show the internal arrangement of the module.
Figure 6:
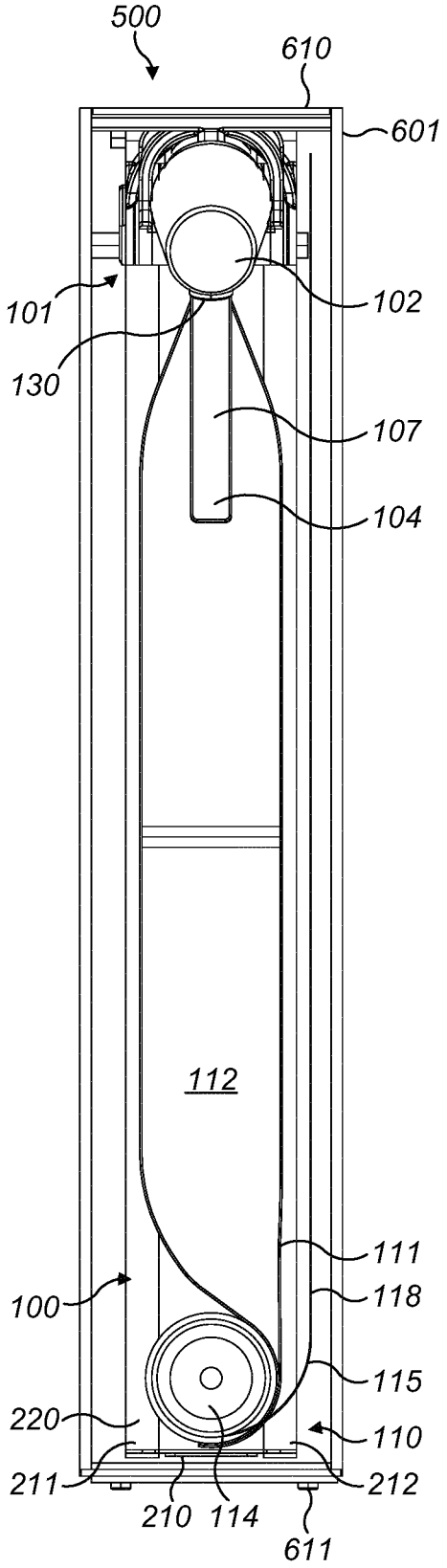
FIG. 6 is a front elevation of the module of FIG. 2 with a front wall hidden to show the internal arrangement of the module.
Figure 7:
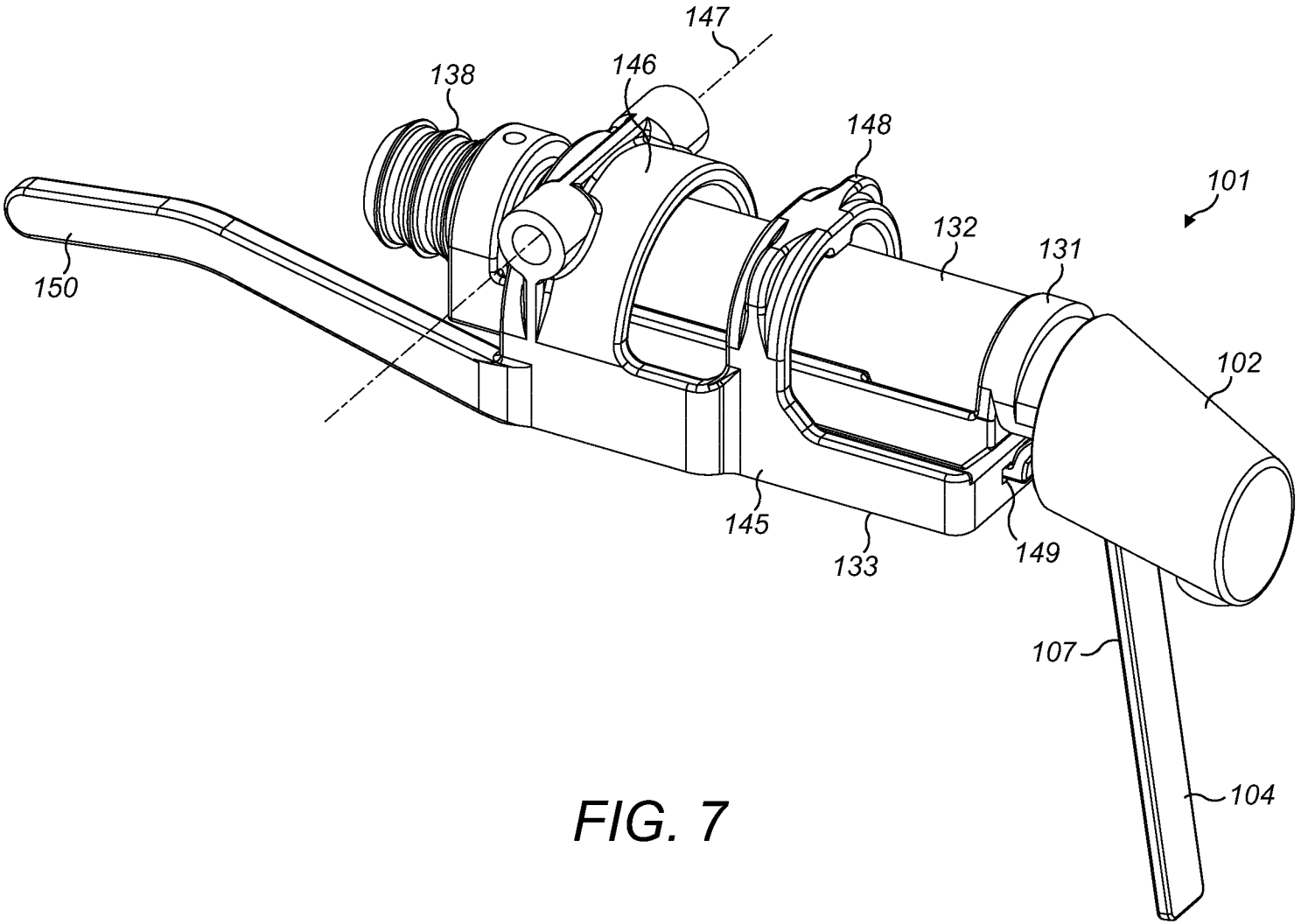
FIG. 7 is a perspective view of an outlet arrangement of the module of FIG. 2.

One or more load sensing means 23 for determining the amount of beverage remaining in each module 500 may also be provided. As illustrated in FIG. 5, the load sensing means 23 are preferably provided in the lower housing 22 and the support surface 21 is mounted to the load sensing means 23. Thus substantially all of the load of the support surface 21 is supported by the load sensing means 23, which can, therefore, detect the load on the support surface 21. Preferably, there are fewer load sensing means 23 than module locations in order to reduce part count. As illustrated, two load sensing means 23 may be provided, each towards an opposing end of the support surface 21, and there are six module locations. In an alternative embodiment the support surface 21 may be formed of a plurality of separate surfaces for supporting a single module 500 and a load sensing means 23 may be provided under each separate surface for detecting the weight of a single module 500.

Alternatively, the load sensing means 23 may be located in the module(s) 500 and communicated to the base unit 20. In a preferred embodiment the load sensing means 23 are provided as one or more load cells. The load cells preferably a lower power requirement and, in order to reduce power usage. However, the load sensing means 23 may comprise any other suitable type of load sensors. Suitable load sensing means 23 include a dry contact sensor, piezo cells, a volumetric level sensor, a weight measuring sensor (e.g. a load cell), an ultrasonic level transmitter, a magnetostrictive or magnetic level transmitter, a capacitance transmitter, a float or a differential level transmitter. In yet a further alternative, the base unit 20 may comprise a plurality of feet upon which the lower housing 22 is mounted and these feet may comprise the load sensing means 23, such as in the form of load cells. The load sensing means 23 detect the total load on the base unit 20.

The amount of beverage remaining in the module 500 may also be indicated by a display on the module 500 or the base unit 20. For example, the display may comprise an LED that emits a light once the amount of beverage falls below a predetermined level. Alternatively, the electronic display may indicate the amount of beverage in the module 500. In a further alternative, which may also be utilised in any embodiment of the module 500, a user may ascertain the amount of beverage remaining via a transparent window in the module 500.

At least one visual indicator 29, for example in form of one or more LEDs, is also provided in the base unit 20 and is associated with each module location, and thus each module 500. Each visual indicator 29 may be located on the base unit to direct a light upon one or more of the walls 11, 12, 13, 14 of a module 500 present on or in the base unit 20. In particular, each visual indicator 29 may comprise an RGB bulb which shines a white light onto each module 500. However, the RGB bulb may be operated to shine a different colour of light on each module 500 depending upon the status of the dispensing valve 103 and/or the volume of beverage inside the module 500.

The base unit 20 comprises at least one base-module transceiver 301 connected to an electronic circuit and operable to communicate with the first, second and/or shared communication means 201, 214, 222 of one or more of the modules 500. The base-module transceiver 301 may comprise a number of different receiving and/or transmitting means for communication with the or each the first, second and/or shared communication means 201, 214, 222. For example, the base-module transceiver 301 may comprise an RFID reader, an NFC reader, a Bluetooth® interface, a WLAN interface, an inductive sensor or the like.

Preferably a base-module transceiver 301 is provided for each module location such that each module 500 has a dedicated base-module transceiver. In a particular embodiment, as illustrated in FIG. 10, the base unit 20 comprises six base-module transceivers 301. Each base-module transceiver 301 comprises a first transceiver for reading and writing to the storage means 210 of a module 500 via the communication means 201, 214, 222. Each base-module transceiver 301 comprises a second transceiver for communicating with the dispensing valve sensing means 220.

In a particularly preferred embodiment, the storage means 210 may comprise an NFC tag, which also forms the second communication means 201, and the dispensing valve sensing means 220 may comprise one of the aforementioned electric circuits 213, 221, including the switch 215, 225 and a wire coil, which forms the first communication means 222. The first transceiver comprises an NFC transceiver for communicating at approximately 13.56 MHz and the second transceiver comprises an inductive sensor for communicating at approximately 200 MHz.

In a further embodiment the NFC tag and wire coil of may be integrated with one another into a single, shared, communication means 209. The wire coil may receive electrical power from the inductive sensor and provide this power to the NFC. The NFC may not operate until it has sufficient power to read and write to its memory. Once operational, it can be interrogated by the NFC transceiver.

In yet a further embodiment, only a single base-module transceiver 301 may be provided for communication with all modules 500 located on or within the base unit 20. For example, an antenna may be provided adjacent to each mount for a module 500 (e.g. between the aforementioned lugs 25). The antennas lead to a multiplexer and the multiplexer is attached to a combined NFC and inductive sensor. The signals are sent to and received from each antenna sequentially. The same operability as six different NFC sensors and inductive sensors may be provided by sequentially switching between each antenna rapidly. A short burst of energy from sensor may interrogate the wire coil only. A longer burst of energy may provide sufficient power to the NFC such that it is triggered for interrogation. Such an arrangement is preferred as it reduces the component count within the base unit 20.

The base unit 20 further comprises a control unit 303 in communication with the load sensing means 23, at least one base-module transceiver 301 and at least one visual indicator 29. A pulse width modulation arrangement may be provided within or connected to the control unit 303 for controlling the at least one visual indicator 29. The control unit 303 is also operable to rapidly issue and receive signals to/from each base-module transceiver 301 sequentially within 200 ms. The control unit 303 may only initially communicate with the dispensing valve sensing means 220 of each module 500 and, if a module 500 presence is determined, subsequently communicate with storage means 210.

The control unit 303 preferably comprises one or more processing units, and a real time clock for data logging. A power supply, in the form of rechargeable batteries and a mains supply, is also connected to provide power to the control unit 303. The base unit 20 may be arranged to be mounted on a charging stand, which may charge control unit 303 wirelessly via inductive charging. A number of input devices, such as switches or buttons, may be located in or on the base unit 20 and connected to the control unit 303 for providing an input to the control unit 303.

The control unit 303 further comprises a memory for storing data relating to individual modules 500, and particularly the module data stored on the storage means 210 of each module 500. Thus, for a plurality of modules 500, the memory of the control unit 303 may further store data including at least one of the aforementioned: beverage information relating to the type of beverage stored in the reservoir, the module history, module identification, the module weight, the dispense status, flow rates and/or the like. The memory may also comprise non-module 500 related data, such as website content, advertising content, application installation software, user profiles and general beverage information. The memory of the control unit 303 may store module data for more modules 500 than the base unit 20 can support. The module data stored by the memory relating to the plurality of modules 500 will be referred to herein as the "module data library". Furthermore, the control unit 303 may store the valve status signal in the memory as binary valve status data. For example, if a valve status signal is generated then the valve status data is set to a "1" and if it is not generated the valve status data is set to a "0".

The base unit 20 further comprises a base-device transceiver 302 connected to the control unit 303 for enabling communication from the control unit 303 to the computing device 190. Preferably the base-device transceiver 302 is arranged to wirelessly exchange information between the control unit 303 and the computing device 190. For example, the base-device transceiver 302 comprises a WLAN interface, Bluetooth™ receiver/transmitter, a wifi (wireless) transmitter/receiver, a mobile data transceiver, an NFC transceiver or otherwise.

It will be appreciated that, although the control unit 303, base-device transceiver 302, visual indicators 29, base-device transceiver 302, load sensing means 23 and power unit have been described separately, they may all be integrated into single circuits and/or the like. Furthermore, each component may be mounted in a suitable manner within the base unit 20.

4. The Computing Device

FIG. 9 illustrates in schematic form the manner in which the module 500, and base unit 20, of the beverage dispensing system 600, and the portable computing device 190, communicate with one another so as to allow a user to control the dispensing of beverage from the module 500.

Although the computing device 190 is shown as a portable device separate from the base unit 20 and comprising a tablet computer or a smart phone, in other embodiments (not shown), the computing device 190 may instead comprise a dedicated hardware unit having software operable solely to control and/or communicate with the base unit 20. The computing device 190 may comprise a personal computer, a tablet computer, a mobile telephone or a dedicated portable handset. For example, the computing device 190 might comprise or include one or more of a processor, a RAM, a ROM or other memory, a display device, one or more input/output devices and communication means between them. The memory preferably stores at least one of network browser software, website content, application software, the module data library, user profiles, advertising content, a link and/or the like.

The content relating to a user profile includes one or more of each of, or a combination of: user contact details, user preferred payment information, user preferences and user history. The user history may include at least one of: previous purchases of beverages and/or related products, previous use of the beverage dispensing system 200, previous consumption rate of beverage from modules 500, previous mixes of beverages made from modules 500 and/or the like.

Indeed the computing device 190 when not constituted by a user's tablet or smart phone but instead by a dedicated hardware configuration need not even be separate from the base unit 20 and module 500; instead the computing device 190 could be formed integrally with the base unit 20 with some form of user interface (such as a touch screen) to allow a user to input instructions to the beverage dispensing system 600.

In use, in the preferred embodiment illustrated in FIG. 9, the appropriate software application is run upon the computing device 190. This acts as a user interface, further details of which will be set out below, to allow a user interactively communicate with the base unit 20. Particularly preferred user interface schemes provide for the computing device 190 to interact with, separately, multiple modules 500 each positioned upon the base unit 20 and each containing different alcoholic and/or non alcoholic beverages. In this manner, the user may interact with the computing device 190 to allow the creation of cocktails and other mixtures of the various beverages available in the multiple modules 500 on the base unit 20.

The computing device 190 comprises a wireless transceiver 203 for communication with the base-device transceiver 302. This may be, for example, a Bluetooth™ receiver/transmitter, a wifi (wireless) transmitter/receiver, a mobile data transceiver, an NFC transceiver or otherwise. The wireless transceiver 203 in the computing device 190 is preferably configured to communicate with the base-device transceiver 302 in the base unit 20. However, depending upon the form of the communication means 201, 214, 222 in the modules 500 and wireless transceiver 203, the computing device 190 may be operable to also communicate directly with the storage means 210 and/or dispensing valve sensing means 220 of the module 500. For example, if the wireless transceiver 203 comprises and NFC transceiver, and the storage means 210 is in the form of an NFC tag, the wireless transceiver 203 may be operable to and/or write to the storage means 210.

The computing device 190 is also optionally connected to and operable to transfer data with a network 204, for example the Internet. One or more computer servers 205 may also be connected to the network 204. Each server 205 comprises a memory 207, the memory 207 storing one or more databases 206. The memories 207 and/or database(s) 206 of the one or more servers 205 host at least one of network browser software, website content, application software user profiles, advertising content and/or the like. The memories 207 and/or database(s) 206 preferably further store module data relating to individual modules 500, and particularly the data stored on the storage means 210 of each module 500. The module data library stored on the memory of the control unit 303 may be replicated on the servers 205. Thus, for each module 500, the memories 207 and/or database(s) 206 may further store data including at least one of: beverage information relating to the type of beverage stored in the reservoir, advertising content, a link, the module history, module identification, the module weight, the dispense status, flow rates and/or the like. Such data could be stored upon the computing device 190, as a part of the application data of the software running on that, or even elsewhere such as in cloud storage or a server 205 connected to a network 204 (see below).

5. System Operation

The control unit 303 is operable to control the outputs of the at least one visual indicator 29, the at least one base-module transceiver 301 and the base-device transceiver 302. The control unit 303 of the base unit 20, via the at least one base-module transceiver 301 and first, second and/or shared communication means 201, 214, 222 of one or more of the modules 500, is operable to receive the data on the storage means 210 and the valve status signal. The control unit 303 is also operable to receive load data from the load sensing means 23 and, if present, inputs from the input devices.

The beverage dispensing system 600 is arranged to perform a number of operations. As will be appreciated from the following description, one or more of the operations may be implemented simultaneously and some operations require the implementation of one or more other modes in order to be implemented. The operations include:

A module presence operation in which it is determined whether a module 500 is or is not present and/or has been added to or removed from each module location of the base unit 20. In this operation the control unit 303 attempts to download the module data from the storage means 210 of each module 500 present via the communication means 201, 214, 222 and each base-module transceiver 301. Alternatively, the control unit 303 may interrogate the dispensing valve sensing means 220 to determine if it is present. If no data or signal is returned then the control unit 303 determines that there is no module 500 present at a certain module location. If data or a signal is returned then the control unit 303 determines that a module 500 is present at a certain module location. The control unit 303 is arranged to store such presence on its memory and any changes in the presence are logged as an addition/removal of a module 500;

A module-base storage operation in which the control unit 303 reads at least part of the module data on each module 500 and stores it on its memory in the module data library. The control unit 303 may also write new module data from the module data library to the storage means 210 on each module 500. In this operation the communication occurs between the storage means 210 and control unit 303 via the communication means 201, 214, 222 and base-module transceiver 301;

A module dispense status operation in which the control unit 303 determines whether a module 500 is dispensing a beverage. In this operation the control unit 303 interrogates the dispensing valve sensing means 220 via each base-module transceiver 301 and receives the dispensing valve status signal indicative of whether the dispensing valve 103 is open. This interrogation may be repeated continuously or rapidly (particularly if the base-module transceiver 301 comprises an inductive sensor) in order to be able detect immediately when the dispensing begins and ends. The control unit 303 stores the status of the dispensing valve 103 (i.e. dispensing, not dispensing) on its memory in the module data library. The control unit 303 also stores, in the module data library, the time of the start and the end of a dispense event in order to determine how long the dispense event lasted. This data may also be written to the storage means 210 of the relevant module 500 using the module-base communication mode;

A load detection operation in which the control unit 303 determines the total load of the modules 500 place on/in the base unit 20 using the outputs from the load sensing means. This load data is stored in the memory of the control unit 303. It may be necessary to only store the load data after a period of time such that the output from the load sensing means has stabilised. This will, for example, avoid load determinations when pressure is applied by a user to the base unit 20 when adding a module 500 thereto.

A module beverage amount determination operation, described in further detail below, in which the weight/volume of beverage remaining in each module 500 mounted in or on the base unit 20 is determined. In this operation the control unit 303 utilises the data stored from the module presence operation, module dispense status operation and load detection operation. The weight/volume data is stored on the memory of the control unit 303 and may also be written to the storage means 210 of the relevant module 500 using the module-base communication mode. It will be appreciated that, given that the density of the beverage is known by the control unit 303, the weight of beverage remaining is interchangeable with the volume and in the following description "weight" may be interchanged with "volume";

A remaining beverage amount visualisation in which the control unit 303 operates the output of the visual indicators 29 to indicate the remaining beverage weight/volume in a module 500. For example, if the remaining weight/volume is below 10% of the full capacity of the module 500 then the visual indicator may be switched on. In particular, an LED may shine upon the module 500. Alternatively, the control unit 303 may change the output of the visual indicator 29 dependent upon the level of beverage in a module. For example, a light which changes colour and/or intensity could be employed.

A dispense instruction operation, described in further detail below, in which certain modules 500 are highlighted for manual operation by a user using the at least one visual indicator 29. The control unit 303 controls the output of the at least one visual indicator 29 in accordance with instructions received from the user interface on the computing device 190;

A base-device communication operation in which data is communicated between the computing device 190 and control unit 303. For example, the data stored in the module data library is communicated to the computing device 190. Data relating to the dispense instruction mode may be communicated from the computing device 190 to the control unit 303;

A network communication operation in which the computing device 190 exchanges data with the servers 205 or the like on the network 204.

A user interface operation, described in further detail below, in which the computing device 190 implements a user interface for receiving inputs from a user, communicates with the server 205 via the network communication operation and exchanges data with the base unit 20 via the base-device communication operation; and A module authentication operation, described in further detail below, in which the amount of beverage remaining in a module 500 and its module identification data are used.

5.1 Module Volume/Weight Determination

The module beverage amount determination operation utilises various inputs in order to determine the volume and/or weight of beverage remaining in each module 500 mounted in or on the base unit 20. As previously discussed, there may be fewer load sensing means 301 than module locations on the base unit 20 and it is not possible to use only the output from the load sensing means 23 to determine the volume of beverage remaining in and/or weight of each module 500. Instead, in the load detection operation, the outputs from the load sensing means 23 are utilised to determine the total load, resulting from any number of modules 500, on the base unit 20. The module presence operation and module dispense status operation are then also utilised to determine the weights of individual modules 500.

In the module beverage amount determination operation the control unit 303 generally compares module data stored on the module data library, whether on the control unit 303 (as is preferable), the computing device 190 or the server(s) 205, with data received from the module presence operation, module dispense status operation and the load detection operation. When a module 500 is placed in/on the base unit 20 for the first time, the module-base storage operation is implemented to provide data relating to that module 500 in the module data library to provide a basis for subsequent module beverage amount determination operations. The module beverage amount determination operations can be classed as resolvable, in which there is a certainty in the beverage amount remaining in a module 500, and unresolvable, in which there is some uncertainty in the amount of beverage remaining in the module 500.

Resolvable events include the addition or removal of a single module 500 from the base unit 20. Such events will be detected by a change in load detected by the load detection operation. The change in load is the weight of the single module added or removed. The control unit 303 may utilise this load change, the beverage density, empty module weight and the like from the module data library and/or module 500 storage means 210 to determine the amount of beverage remaining in the module 500 added or removed. If added, the volume/weight data is transferred to the storage means 210 and stored in the module data library. If removed, the volume/weight data for the module 500 is stored in the module data library for uploading to the storage means 210 of the module 500 when it is next mounted to the base unit 20 or another base unit 20 (the module data library having been uploaded to and accessed in the server 205). Furthermore, if the user dispenses beverage from the module 500 when it is not on the base unit 20, this calculation during its addition to the base unit 20 can be used to resolve the amount of beverage remaining despite the dispense event not being directly monitored by the base unit 20.

A further resolvable event is the dispensing of beverage from a single module 500 (a "dispense event"). The dispense event will be detected by the module dispense status operation. The load detection operation is also implemented to determine the weight change resulting from the dispense event. Based upon the weight change and time taken for the dispense event, the module flowrate can be calculated and stored in the module data library and/or storage means 210. Furthermore, the control unit 303 updates, after the dispense event, the data relating to the amount of beverage remaining in the module 500 based upon the previous beverage remaining amount stored in the module data library.

Combinations of events may not be directly resolvable by the control unit 303. For example, if two or more modules 500 are added simultaneously it will not be possible to determine the amount of beverage remaining within each module 500 as their individual weights cannot be resolved. If beverage is dispensed from more than one module 500 simultaneously it will not be possible to accurately determine the amount of beverage remaining in each module 500. If one or more modules 500 are removed from the base unit 20 at the same time one or more other modules 500 are added, it will not be possible to accurately determine the amount of beverage remaining in each of the exchanged modules 500. Furthermore, if one or modules 500 are added or removed from the base unit 20 whilst beverage is dispensed from one or more modules 500, it will not be possible to accurately determine the amount of beverage remaining in every module 500.

It will be appreciated that a user could add and remove every module 500 from the base unit 20 sequentially in order to determine the correct amount of beverage remaining in each module 500 (i.e. to "reset" the system 600). However, this reset requirement is not preferable as the user may be unaware that the beverage volume remaining data stored is not accurate. Therefore, the control unit 303 includes a process for approximating the amount of beverage remaining in one or more modules 500 after unresolvable events.

In this process, when the amount of beverage remaining is uncertain for a module 500, the control unit 303 will assign a beverage amount range to each module 500, which represents the possible ranges of volume/weight of beverage that could be held within the module 500. The control unit 303 may represent the range by assigning an estimated beverage amount value and an uncertainty value to the module 500. The estimated beverage amount value will be the most likely value determined by the control unit 303 or, if there is no likely value, the median value in the range it could be. The uncertainty value provides the range the beverage amount value could be above or below the estimated beverage amount value (i.e. the possible error). The range and/or values are stored on the storage means 210 and/or module data library.

In a first example two modules 500 are added simultaneously to the base unit 20 and their storage means 210 and the module data library do not contain a previously determined beverage weight remaining value for either module 500. The total weight of beverage within both modules 500 is determined as 200 g by detecting the total load on the base unit 20 and subtracting the empty module weights from the total load. The control unit 303 will therefore allocate each module 500 with an estimated beverage weight range of 0-200 g. Alternatively, the control unit 303 may assign an estimated beverage weight remaining value of 100 g to each module 500, since this is the median weight in the range the value could be (the range being 0-200 g of beverage). The control unit 303 will allocate each module 500 with an uncertainty value of ±100 g, since each module 500 could hold between 0 g and 200 g of beverage. If the beverage weight remaining is subsequently calculated accurately for one of the modules 500, for example if it is removed from or added to the base unit 20, then the control unit 303 can calculate the beverage weight remaining for the other module 500.

In a further example there are two modules 500, referred to as A and B. The module data library stores a beverage weight value for module A as 50 g and a beverage weight value for module B as 500 g. Both modules A and B are removed from the base unit 20, beverage is dispensed from at least one of them and then they are replaced on the base unit 20. From the addition of both modules A and B it is determined that the total weight of beverage in both modules is now 350 g, i.e. the dispensing away from the base unit 20 involved a weight change of 200 g of beverage. The control unit 303 can then assign an estimated beverage weight remaining range of 0-50 g for module A and an estimated beverage weight remaining range of 300-350 g for module A. Alternatively, the control unit 303 may look to assign the median value of this weight change equally between the two modules, i.e. 100 g each. However, as the previous beverage weight value for module A is 50 g it will allocate an estimated beverage weight remaining of 0 g and an uncertainty value of +50 g to module A. The control unit 303 can then allocate an estimated beverage weight remaining of 350 g and an uncertainty value of −50 g to module B.

5.2 Module Authentication

The module authentication operation is provided to assist in detecting the refilling of a module 500 and to ensure that the module 500 is a genuine module. In one embodiment the servers 205 may be arranged to receive the module identification data relating to an individual module 500 via the module-base storage operation, base-device communication operation and network communication operation. The server 205 is operable to compare the module identification data with authentication codes listed on the database 206. Alternatively or in addition, cryptographic public/private key exchange may be implemented between the storage means 210 and control unit 303 for the module identification data.

As previously discussed, the servers 205, control unit 303 and computing device 190 may store the module data library, which will include a previously determined beverage weight/volume remaining value for certain modules 500. If the module weight/volume determination operation returns a value higher than the previously determined beverage weight/volume remaining value for a certain module 500 then the module 500 will have been refilled. Therefore, the beverage within the module 500 may not be the beverage intended for consumption from the module 500 and the module 500 is no longer authentic.

If a lack of authentication is found then it is flagged to the operator of the server 205. Furthermore, the user interface operation on the computing device 190 can be disabled where a lack of authentication is detected.

5.3 User Interface

Figure 12:
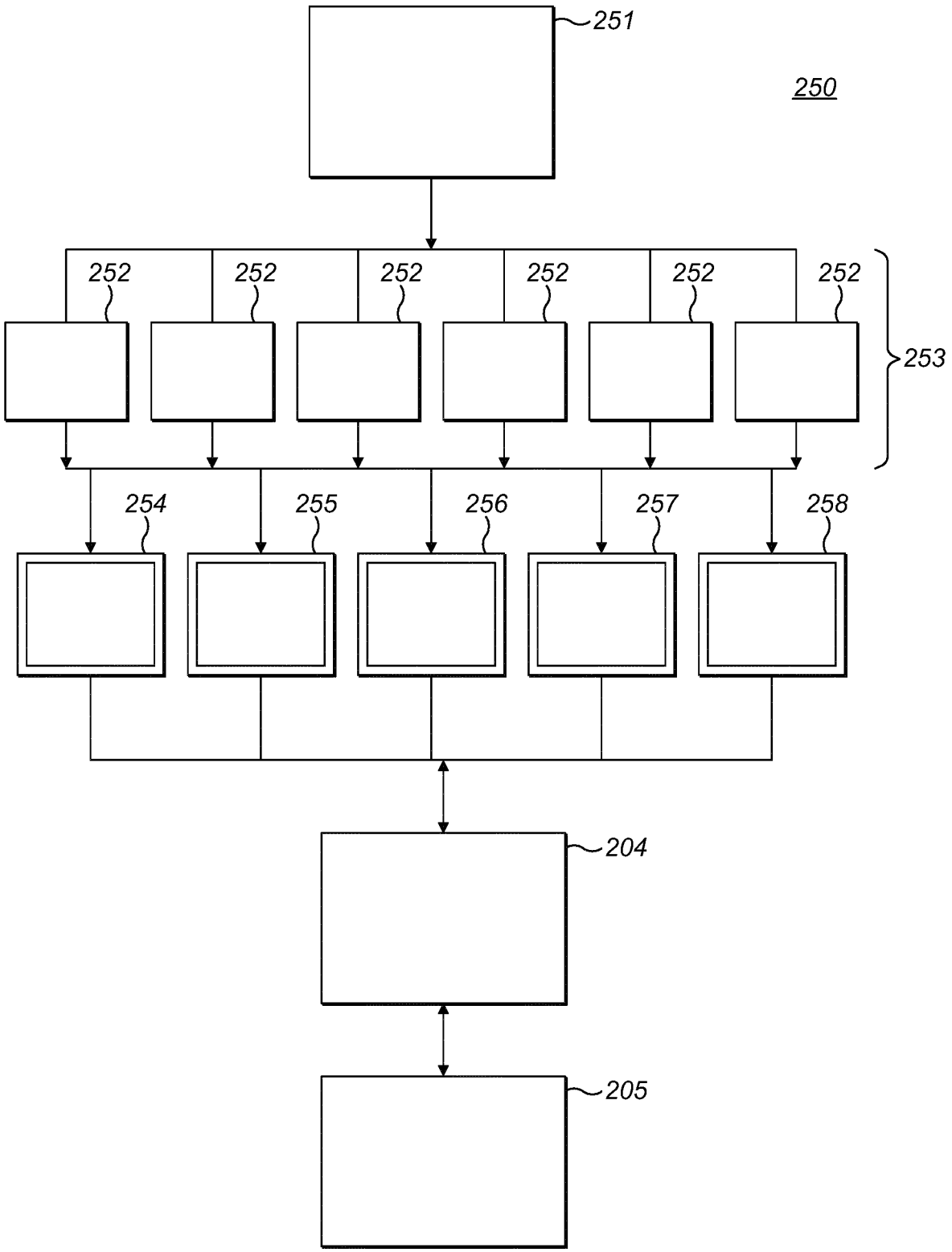
FIG. 12 is a schematic of a user interface of the present invention.

In the user interface operation the computing device operates a network browser or application on the computing device 190 which provides a user interface 250. The user interface 250 enables the user to interact with a website or the application. FIG. 12 illustrates a particular embodiment of a user interface 250 comprising an initial input 251. The initial input 251 may be a manual input from a user (e.g. via an input device, such as a touch screen, of the computing device 190). Alternatively or in addition, the initial input 251 may result from the base-device communication operation. In particular, in response to a manual input the computing device 190 may implement a base-device communication operation and receive data from the base unit 20.

In the embodiment in which the computing device 190 can directly communicate with the storage means 210 of a module 500, the computing device receives the data stored on storage means 210, software on the computing device 190 interprets the content and subsequently launches an activity. For example, the computing device 190 software may interpret a link file path and subsequently launch an application stored on its memory. Alternatively, the computing device 190 interprets a URL link, is directed by the URL via the network 204 to the server(s) 205, downloads application installation software from the server(s) 205, installs an application utilising the application installation software and preferably subsequently launches the application. As a further alternative, the computing device 190 interprets a website address, launches a network browser, connects to the server(s) 205 via the network 204 and subsequently downloads to the network browser the web content stored on the server(s) 205. The computing device 190 may also download the module data and advertising content. The display device of the computing device 190 may then display this content.

Following on from the initial input 251 the user interface 250 may, in a module status visualisation 253, display the information relating to each beverage type 252 present in the modules 500 on the base unit 20. The computing device 190 is operable to receive, via the base-device communication operation, all data stored on the control unit 303, such as that in the module data library, and on storage means 210 on any module 500 present on the base unit 20. The computing device 190 may then display this information for the user on its display device as a in a module status visualisation 253. In particular, the computing device 190 is arranged to display the data relating to the beverage amount remaining in each module 500 on the base unit 20 (i.e. the output from the module weight/volume determination operation). In particular, the computing device 190 may display the estimated beverage amount remaining range for each module 500. The computing device 190 may also provide a display indicating whether a dispensing valve 103 of a module 500 has been actuated (i.e. the output from the module dispense status operation). The computing device 190 may also display the detected flowrate of beverage from one or more modules 500. The information relating to each module 500 may be visible separately and/or together with the information relating to other modules 500.

The user interface 250 provides several options for proceeding to a user that relate to the beverage types 252 present in the modules 500 on the base unit 20. The options may comprise an instructor function 254 for coaching the user through the preparation of a beverage, an online ordering function 255 through which the user can order further modules 500, a social networking function 256 for connecting the user to one or more social networks, an events function 257 via which the user can see information on events related to the beverage type 252 and a beverage information function 258. The beverage information function 258 provides beverage information to the user.

Each of the functions 254, 255, 256, 257, 258 may download or upload content from/to the one or more server(s) 205 via the network 204. For example, the instructor function 254 may download from the user profile the previous history of beverages prepared by the user and utilise this history to suggest further associated beverages that can be prepared. The instructor function 254 may also upload to the user profile the beverages selected for preparation by the user, thereby recording such a history. However, functionality may be provided on the computing device 190 to record this history for later access by the instructor function 254. The data captured from each user stored in the database(s) 206 may be combined with that of other users in order to assess global preferences and the like.

The online ordering function 255 may be operable to automatically order a further module 500 via the network 204 from a supplier when the amount of beverage remaining in the module 500 falls below a predetermined amount. The amount of beverage remaining in the module 500 is detected by the load sensing means 23 and transferred to the computing device 190, as previously described. The computing device 190 compares the data received and compares it with a predetermined value. If the data indicates that the amount of beverage in the module 500 is below a predetermined level, the order is sent to the supplier.

5.4 Instructor Function

The instructor function 254 coaches a user through the preparation of a mixed beverage based upon the beverage types in the modules 500 on the base unit 20. The instructor function 254 may also provide suggestions to a user as to beverages that can be made utilising the selected beverage type 252. For example, the instructor function 254 may indicate beverages that can be formed by mixing the beverage type 252 with other beverages and/or food products and comprise a step-by-step guide for creating the mixed beverage. The instructor function 254 may indicate preferred presentations of the beverage type 252, such as temperature and/or drinking vessel type (e.g. type of glass). The instructor function 254 may also indicate any foods with which the beverage type 252 is preferably consumed.

The user may also be able to input into the instructor function 254 the food products and/or beverages available to the user. The instructor function 254 is operable to suggest mixed beverages that may be formed utilising these food products and/or beverages. The instructor function 254 may also suggest mixed beverages that are related to events in a calendar application on the computing device 190. The instructor function may suggest mixed beverages based upon weather information downloaded from the network 204.

The control unit 303 and/or computing device 190 may also indicate whether certain mixed beverages can be made based upon the beverage amount range or detected amount of beverage remaining in each module 500. For example, if a module 500 only has 50 g of beverage remaining then the instructor function 254 will indicate that a mixed beverage requiring 100 g cannot be made. If the beverage amount range is from 0-50 g then the instructor function 254 will also indicate that a mixed beverage requiring 100 g cannot be made. However, the instructor function 254 may indicate that a drink requiring 50 g may possibly be made (depending upon whether actual amount of beverage remaining is 50 g).

The user may select a mixed beverage which can be made in the instructor function 254. The system 600 therefore implements the dispense instruction operation and instructions are issued from the computing device 190 to the control unit 303 in the base unit 20. These instructions relate to an amount of beverage to be dispensed from one or more modules 500 and, based upon these instructions, the control unit 303 operates one or more visual indicators 29 associated with one or more modules 500. The visual indicators 29 may highlight one or more modules 500 sequentially in order to indicate to a user how to make a mixed beverage.

The user places a drinking vessel adjacent to the module 500 being highlighted by the visual indicator 29 and actuates the dispensing lever 107 to dispense beverage from the module 500. During dispensing the load detection operation is implemented in order to determine the change in load during the dispense event. The control unit 303 and/or computing device 190 utilise the beverage density information and change in weight on the base unit 20 to determine when the correct volume has been dispensed to form the mixed beverage. Once the correct volume has been dispensed the visual indicators 29 are operated to indicate to the user that they should stop actuating the dispensing lever 107. For example, the visual indicators 29 may be switched off or may change colour. If beverage from several modules 500 is to be used in the creation of the mixed beverage, a number of modules 500 are sequentially highlighted for certain periods of time.

However, the monitoring of the change in load during dispensing may not be sufficiently accurate as the force applied to the dispensing lever 107 by the user may be transmitted through the module 500 to the base unit 20, thereby interfering with the accurate measurement of the change in weight during dispensing. As a result, it is preferable to indicate to the user that they should stop actuating the dispensing lever 107 after a certain period of time based upon the flowrate of beverage from the module 500. It will be appreciated that the flowrate may vary throughout the lifetime of the module 500, for example resulting from the relaxation of the resilient bias means 115. Therefore, the flowrate used to determine the time period for a dispense event is estimated and recalculated throughout the lifetime of the module 500.

As previously disclosed herein, the module data on the storage means 210 includes flow rate data. When the module-base storage operation is implemented this data is stored in the module data library on the memory of the control unit 303. When a module 500 is first used, the control unit 303 utilises the predetermined flowrate value or range to determine the time that a dispense event should last based upon the desired amount of beverage to be dispensed.

Upon receiving an input to provide instructions to create a certain mixed beverage, the system 600 implements the dispense instruction operation and instructions are issued from the computing device 190 to the control unit 303 in the base unit 20. These instructions relate to an amount of beverage to be dispensed from one or more modules 500 and, based upon these instructions, the control unit 303 utilises the predetermined flowrate value to determine the required time period for operating the at least one visual indicator 29 to provide the correct amount of beverage. The control unit 303 subsequently operates one or more visual indicators 29 associated with one or more modules 500. The user places a drinking vessel adjacent to the module 500 being highlighted by the visual indicator 29 and actuates the dispensing lever 107 to dispense beverage from the module 500. The module dispense status operation detects the actuation and records the start time. Upon reaching the end of the time period, or just before the end, the control unit 303 operates the visual indicators 29 to indicate to the user that they should stop actuating the dispensing lever 107. For example, the visual indicators 29 may be switched off or may change colour.

After the dispense event the control unit 303 utilises the change in amount of beverage, determined by multiple module beverage amount determination operations, and the time of the start and end of a dispense event, determined by the module dispense status operation, to determine the average flowrate throughout the dispense event. The control unit 303 subsequently stores this flowrate as a measured flowrate value in the module data library on the control unit 303 and/or computing device and/or on the storage means 210 of the module 500. Alternatively, the average flowrate may be compared with the predetermined flowrate and the measured flowrate value is stored as a scale factor between the two. This measured flowrate is utilised by the control unit 303 in determining the time period for dispensing in a subsequent dispense event from that module 500.

If beverage from several modules 500 is to be used in the creation of the mixed beverage, one or more other modules 500 may be subsequently highlighted. In particular, the highlighting of the next module 500 may begin once dispensing from the first module 500 has finished. The time period for dispensing from the next module 500 may start once the user actuates the dispensing lever 107 of the subsequent module 500.

After each dispense event from each module 500 the measured flowrate value for each module 500 is updated utilising the time period and change in amount of beverage determined for each module 500 as previously discussed. Such a feedback loop compensates for changes in the pressurising force provided by the pressurising arrangement 110, the differing viscosities between different types of beverages and the different age of modules 500 (which may affect the pressurising force and/or viscosity). The flowrate of a beverage from a module 500 will depend upon its viscosity. The manufacturer can set the predetermined flowrate according to tests performed on the module 500 prior to sale. After the first dispense event, all subsequent calculations of the measured flowrate will take the viscosity into account. Thus the feedback loop can be applied accurately to any type of beverage in the module 500.

Furthermore, since the module data library stores information linking the flowrates to specific modules 500, different time periods can be indicated by a single visual indicator 29 for different modules 500. For example, a first module 500 has a first flowrate associated therewith and is in/on a module location such that it may be highlighted by a first visual indicator 29 for a first time period in the dispense instruction operation. Subsequently, the first module 500 is replaced in/on the base unit 20 by a second module 500 having a second flowrate associated therewith. The control unit 303 can, in a new dispense instruction operation, control the first visual indicator 29 to highlight the second module 500 for a second time period calculated from the second flowrate and beverage type data stored on the storage means 210 of the second module 500. Thus the dispense instruction function can operate independently of the arrangement of modules 500 on the base unit 20.

During dispensing, the user interface 250 may be arranged to provide a certain display to the consumer when a dispensing valve 103 has been opened on one or more of the modules 500. The user interface 250 and/or visual indicators 29 may indicate when to stop dispensing in order to indicate to the user that a certain volume of beverage has been dispensed.

The invention claimed is:

1. A method of controlling a beverage dispensing system, said system comprising:

a base unit comprising a plurality of module locations and a plurality of visual indicators controlled by a control unit; and a plurality of modules mounted in or on the base unit at the module locations, each module comprising:

a container;

a dispensing arrangement attached to the container for dispensing beverage from a beverage reservoir, the dispensing of beverage being controlled by a manually openable dispensing valve, the dispensing arrangement comprising the beverage reservoir and manually openable dispensing valve; and storage means attached to the container storing module data including a predetermined flowrate of beverage from the module;

wherein each beverage dispensing module is separable from the base unit;

wherein each visual indicator is associated with a module location;

wherein the method comprises the steps of:

communicating the module data from the storage means of a first module to the control unit;

calculating a time period for the dispensing of beverage from the first module based upon the predetermined flowrate and a desired amount of beverage to be dispensed; and indicating the first module with the associated visual indicator for the calculated time period.

2. A method as claimed in claim 1 wherein the beverage dispensing arrangement is operable to selectively dispense beverage independently of the base unit.

3. A method as claimed in claim 1 wherein each module further comprises valve sensing means operable to determine whether the dispensing valve is open and the method further comprises the steps of:

communicating a dispensing valve signal indicative of whether the dispensing valve is open to the control means, wherein in the indicating step:

(i) the first module is indicated with the associated visual indicator;

(ii) an opening of the dispensing valve is detected; and (iii) the indication of the first module is stopped once the calculated time period has expired, said calculated time period starting upon detection of the opening of the dispensing valve.

4. A method as claimed in claim 1 wherein the base unit further comprises load sensing means in communication with the control unit and arranged to determine a total weight of the each module mounted in or on the base unit, and the method further comprises the steps of:

determining the total weight of the first module; and storing the weight as load data in a control unit memory.

5. A method as claimed in claim 4 further comprising the steps of, after ending of the indicating of the at least one module by the at least one visual indicator:

calculating a measured flowrate based upon a measured time between a start and end of the dispensing of beverage, determined from valve status data, and a measured amount of beverage dispensed, determined from load data;

storing the measured flowrate on the control unit memory and/or storage means on the module; and calculating a further time period for the dispensing of beverage from the at least one module based upon the measured flowrate and a desired amount of beverage to be dispensed.

6. A method as claimed in claim 1 wherein the base unit comprises at least a first and a second visual indicator and at least a first and a second module are provided, wherein the method comprises the steps of:

communicating the module data from the storage means of the at least first and second module to the control unit;

calculating first and second time periods for the dispensing of beverage from the first and second modules respectively, said calculation being based upon first and second predetermined flowrates stored on the storage means of the first and second modules respectively and a desired amount of beverage to be dispensed from each of the first and second modules; and indicating the first module with the first visual indicator for the first time period and subsequently indicating the second module with the second visual indicator for the second time period.

* * * * *